US007966912B1

(12) United States Patent
Hobden et al.

(10) Patent No.: US 7,966,912 B1
(45) Date of Patent: Jun. 28, 2011

(54) RATCHETING WRENCH

(75) Inventors: Robert J. B. Hobden, Kingston (CA); Jamie S. Munn, Maitland (CA); Martin Heckmann, Baltimore, MD (US); Corey D. MacTavish, Ottowa (CA); William G. Harman, Jr., Glen Rock, PA (US); David C. Campbell, Bel Air, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 12/750,224

(22) Filed: Mar. 30, 2010

(51) Int. Cl.
*B25B 13/46* (2006.01)
*B25B 13/06* (2006.01)

(52) U.S. Cl. ..... 81/63; 81/124.5

(58) Field of Classification Search ..... 81/60, 63–63.2, 81/124.4, 125.1, 177.1, 177.2, 177.6, 177.7, 81/177.8, 124.5, 124.7, 176.1
See application file for complete search history.

(56) References Cited

U.S. PATENT DOCUMENTS

| | | | | | |
|---|---|---|---|---|---|
| D53,597 | S | * | 7/1919 | Marcmann | D8/28 |
| 1,331,956 | A | * | 2/1920 | Cross | 81/60 |
| 1,453,607 | A | * | 5/1923 | Saucier | 81/60 |
| 1,571,148 | A | | 1/1926 | Sisolak | |
| 1,796,083 | A | * | 3/1931 | Carlberg | 81/440 |
| 1,811,137 | A | * | 6/1931 | Kress | 81/124.3 |
| 2,491,623 | A | | 12/1949 | Sesak | |
| 2,500,835 | A | | 3/1950 | Lang | |
| 3,044,591 | A | * | 7/1962 | Kilness | 192/43.1 |
| 4,257,507 | A | * | 3/1981 | Solomon | 192/43.1 |
| 5,325,744 | A | | 7/1994 | Horikawa | |
| 5,568,751 | A | | 10/1996 | Lee | |
| 6,125,725 | A | | 10/2000 | Fox et al. | |
| 6,263,768 | B1 | * | 7/2001 | Huang et al. | 81/63 |
| 6,282,992 | B1 | | 9/2001 | Hu | |
| 6,453,779 | B2 | | 9/2002 | Hu | |
| 6,626,067 | B1 | | 9/2003 | Iwinski et al. | |
| 6,629,477 | B2 | | 10/2003 | Ling et al. | |
| 6,722,234 | B2 | | 4/2004 | Hu | |
| D492,556 | S | | 7/2004 | Barry et al. | |
| 6,769,330 | B2 | | 8/2004 | Chang | |
| 6,782,777 | B1 | * | 8/2004 | Wei | 81/177.85 |

(Continued)

FOREIGN PATENT DOCUMENTS

DE 202006019735 U1 3/2007

OTHER PUBLICATIONS

Photo of Snap-On Ratcheting Box Wrench, 25 degree Offset, Standard Length 1/2"-9/16", 12-Point, Stock#: RYA1618.

(Continued)

*Primary Examiner* — David B Thomas
(74) *Attorney, Agent, or Firm* — Stephen R. Valancius

(57) ABSTRACT

A ratcheting wrench having ratchet structure, a ratchet body, a socket wheel, a plurality of ratchet teeth and at least one pawl. The ratchet body is received into the ratchet structure and is rotatable about a first axis. The socket wheel is received in an aperture in the ratchet body and includes a plurality of tool members that are spaced circumferentially apart from one another about a second axis that intersects the first axis but is not coincident with the first axis. The ratchet teeth and the at least one pawl cooperate to control relative rotation between the ratchet structure and the ratchet body about the first axis.

17 Claims, 18 Drawing Sheets

U.S. PATENT DOCUMENTS

| | | | | |
|---|---|---|---|---|
| 6,862,956 | B1 | 3/2005 | Chen | |
| 6,868,759 | B2 | 3/2005 | Tuan-Mu | |
| 6,918,323 | B2 | 7/2005 | Arnold et al. | |
| 6,971,286 | B2 | 12/2005 | Hu | |
| 7,004,052 | B1 * | 2/2006 | Shu-Sui et al. | 81/63 |
| 7,032,478 | B2 | 4/2006 | Hu | |
| 7,066,055 | B1 * | 6/2006 | Lee | 81/63 |
| 7,082,860 | B2 | 8/2006 | Shu-Sui et al. | |
| 7,185,566 | B2 | 3/2007 | Arnold et al. | |
| 7,231,851 | B2 | 6/2007 | Tuan-Mu | |
| 7,237,460 | B2 | 7/2007 | Hu | |
| D551,525 | S | 9/2007 | Desbrunes | |
| 7,267,033 | B1 | 9/2007 | Lai et al. | |
| 7,299,720 | B1 | 11/2007 | Schultz et al. | |
| 7,311,022 | B2 | 12/2007 | Putney et al. | |
| 7,424,839 | B2 * | 9/2008 | Chiang | 81/177.8 |
| 7,444,902 | B1 | 11/2008 | Lin et al. | |
| 7,444,904 | B2 | 11/2008 | Huang | |
| 7,523,688 | B2 | 4/2009 | Putney et al. | |
| D601,871 | S | 10/2009 | Murray | |
| 2004/0040422 | A1 * | 3/2004 | Chuang | 81/177.2 |
| 2004/0093994 | A1 * | 5/2004 | Hsiao | 81/63.2 |
| 2004/0129114 | A1 * | 7/2004 | Chen | 81/63 |
| 2005/0166718 | A1 * | 8/2005 | Chang | 81/60 |
| 2007/0107560 | A1 | 5/2007 | Chiang | |
| 2010/0050818 | A1 * | 3/2010 | Rogers | 81/60 |
| 2010/0326246 | A1 | 12/2010 | Chang | |
| 2011/0017024 | A1 | 1/2011 | Kriz | |

OTHER PUBLICATIONS

Photo of Snap-On Box Wrench, Standard Length, 10 degree Offset, 3/8"-7/16", 12-Point, Stock# XB1214A.

Photo of Blue Point Ratcheting Box Wrench, Latch-On, 0 degree Offset, 1/2"-9/16", 12-Point, Stock#: RBZ1618.

Photo of GearWrench Reversible Ratcheting Combination Wrench, 3/4", 12-Point, Item#: 9532.

Photo of GearWrench Flex Ratcheting Combination Wrench, 7/16", 12-Point, Item#: 9707.

Photo of GearWrench S-Shaped Reversible Ratcheting Wrench, 19mm-22mm, 12-Point, Item#: 85241.

Photo of GearWrench Quadbox Reversible Ratcheting Wrench.

Photo of GearWrench Gearratchet Socket Wrench & Socket Set.

Photos of Gear Wrench Flex Head Packaging.

Photos of Gear Wrench Ratcheting Combination Wrench.

Non-Final Office Action of U.S. Appl. No. 12/161,200 dated Jan. 27, 2011.

* cited by examiner

RATCHETING WRENCH

FIELD

The present disclosure relates to a ratcheting wrench.

BACKGROUND

U.S. Pat. No. 6,769,330 discloses a wrench having an open end wrench portion and a ratcheting box wrench portion. U.S. Pat. No. 1,811,137 discloses a socket wrench having a socket block that is pivotally mounted to a handle; the socket wrench does not have any capability to ratchet. There remains a need in the art for an improved ratcheting wrench.

SUMMARY

This section provides a general summary of the disclosure, and is not a comprehensive disclosure of its full scope or all of its features.

In one form, the present teachings provide a ratcheting wrench that includes a ratchet structure, a ratchet body, a socket wheel and a one-way clutch. The ratchet structure has a body. The ratchet body is received in the body of the ratchet structure and is rotatable relative thereto about a first axis. The socket wheel is pivotally coupled to the ratchet body for rotation about a second axis, which is perpendicular to the first axis. The socket wheel includes a plurality of tool members that are spaced circumferentially apart from one another about the second axis. The one-way clutch couples the ratchet body and the body of the ratchet structure.

In one form, the present teachings provide a ratcheting wrench that includes a ratchet structure, a ratchet body, a plurality of ratchet teeth, at least one pawl, a pawl spring and a socket wheel. The ratchet structure has an annular body into which the ratchet body is received. The ratchet body defines a socket wheel aperture. The ratchet teeth are fixedly coupled to one of the annular body and the ratchet body, while the at least one pawl is mounted on the other one of the annular body and the ratchet body. The at least one pawl includes a pawl member with a set of first pawl teeth. The pawl spring is configured to bias the pawl member in a direction such that the set of first pawl teeth engage the ratchet teeth. The socket wheel is received in the socket wheel aperture and is coupled to the ratchet body. The socket wheel has a plurality of tool members that are spaced circumferentially apart from one another about a first axis. The at least one pawl is configured to operate in a first mode in which rotation of the ratchet body relative to the ratchet structure in a first rotational direction about a second axis is permitted and rotation of the ratchet body relative to the ratchet structure in a second, opposite rotational direction about the second axis is inhibited. The first and second axes intersect but are not coincident.

In another form, the present teachings provide a ratcheting wrench that includes a handle structure and a pair of ratchet assemblies. The handle structure has a handle and a pair of ratchet structures that are coupled to opposite ends of the handle. Each ratchet structure has an annular body that is disposed about a first axis. Each of the ratchet assemblies is coupled to an associated one of the ratchet structures and includes a ratchet body, a socket wheel, at least one pivot pin, and a ratchet clutch. The ratchet body is received in the annular body of the ratchet structure and is rotatable relative thereto about the first axis. The ratchet body includes a pair of yokes that define a second axis that is perpendicular to the first axis. The socket wheel includes a pair of rotary hubs and at least four tool members that are spaced circumferentially about the rotary hubs. Each of the tool members defines a bore that is configured to drivingly engage a head of a fastener. The at least one pivot pin pivotally couples each of the rotary hubs to a respective one of the yokes to facilitate rotation of the socket wheel about the second axis. The ratchet body is coupled to the associated one of the ratchet structures through the ratchet clutch.

In still another form, the present teachings provide the following:

a) a packaging system comprising a package and a connector assembly that is received through the package, the connector assembly having a first connector, which is non-rotatably mounted to the package, and a second connector that is engaged to the first connector, wherein the first and second connectors cooperating to form a torque clutch that permits relative rotation between the first and second connectors when a torque applied through the first and second connectors exceeds a predetermined torque;

b) a ratcheting wrench comprising a handle, a pair of yokes, a pair of socket wheels and a ratchet assembly, the handle having at least one set of ratchet teeth formed thereon, the yokes being coupled to opposite ends of the handle, each of the socket wheels being pivotally mounted on an associated one of the yokes, and the ratchet assembly being received on the handle between the yokes and being configured to engage the ratchet teeth;

c) a ratcheting wrench comprising a ratchet assembly and a socket wheel, the ratchet assembly including a drive member, the socket wheel comprising plurality of tool members and a plurality of driving features, the socket wheel being enagageable to the drive member such that at least a portion of the one of the tool members extends into the drive member and a set of the driving features are drivingly engaged to the drive member; and d) a kit comprising a handle and a plurality of socket wheels that are can be removably coupled to the handle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 26:
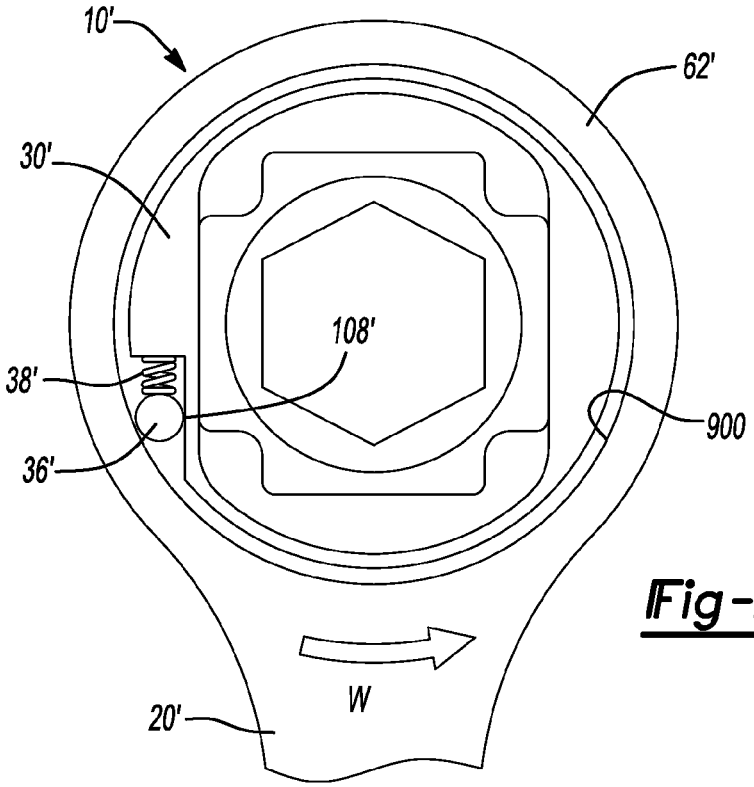
Figure 28:
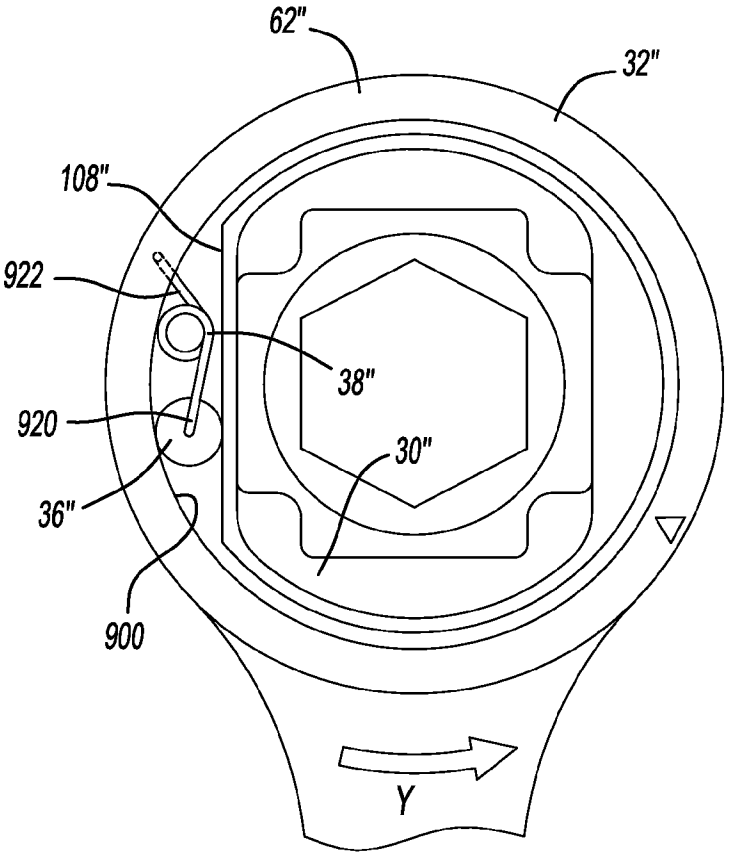
Figure 27:
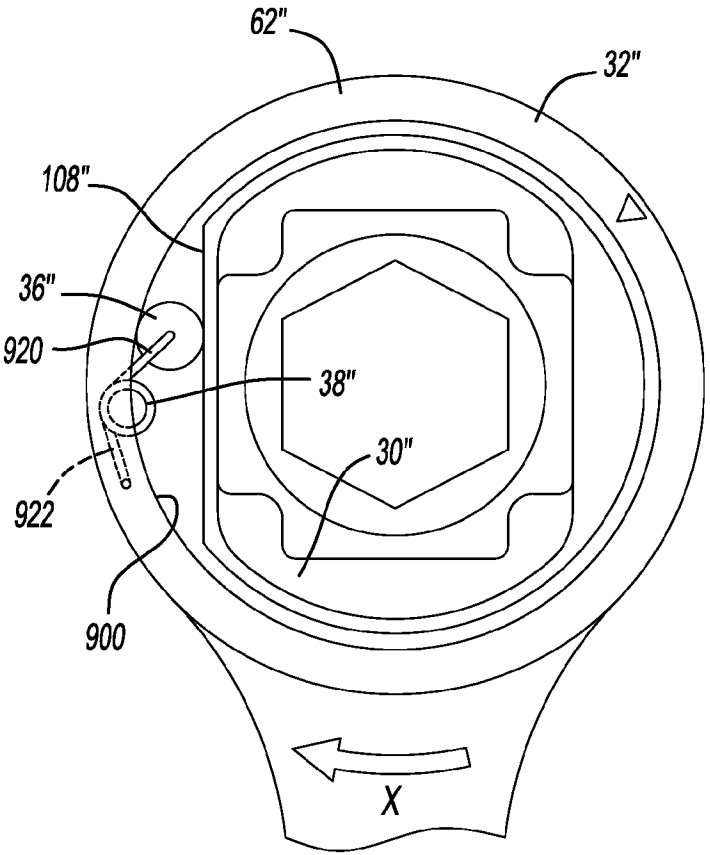

FIG. 26 is a schematic illustration of yet another ratcheting wrench constructed in accordance with the teachings of the present disclosure; and FIGS. 27 and 28 are schematic illustrations of a further ratcheting wrench constructed in accordance with the teachings of the present disclosure, with the one-way clutch being depicted as being set to permit rotation in a first rotational direction and in a second rotational direction, respectively.

Corresponding reference numerals indicate corresponding parts throughout the several views of the drawings.

DETAILED DESCRIPTION

Example embodiments will now be described more fully with reference to the accompanying drawings. The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
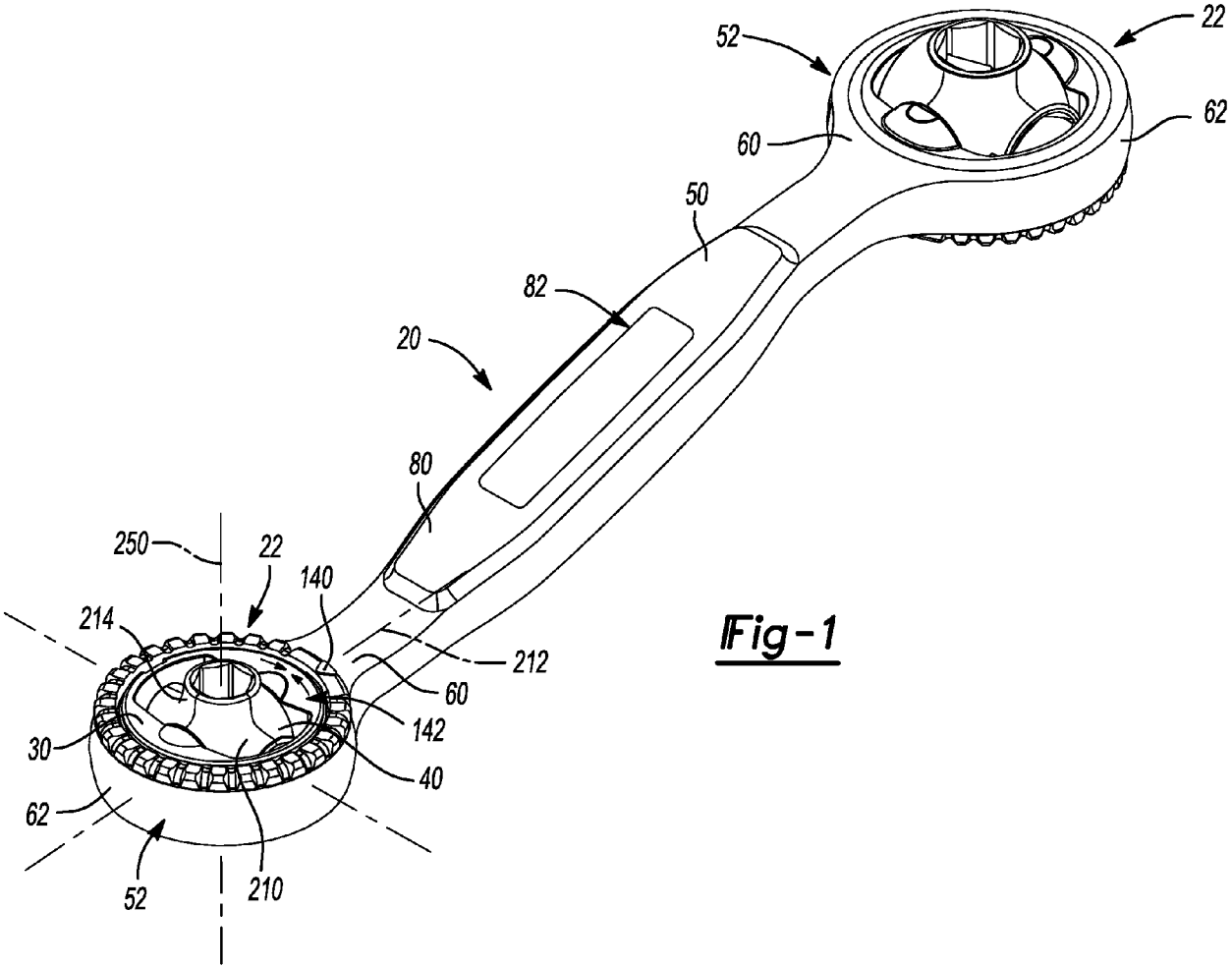
FIG. 1 is a perspective view of an exemplary ratcheting wrench constructed in accordance with the teachings of the present disclosure.
Figure 2:
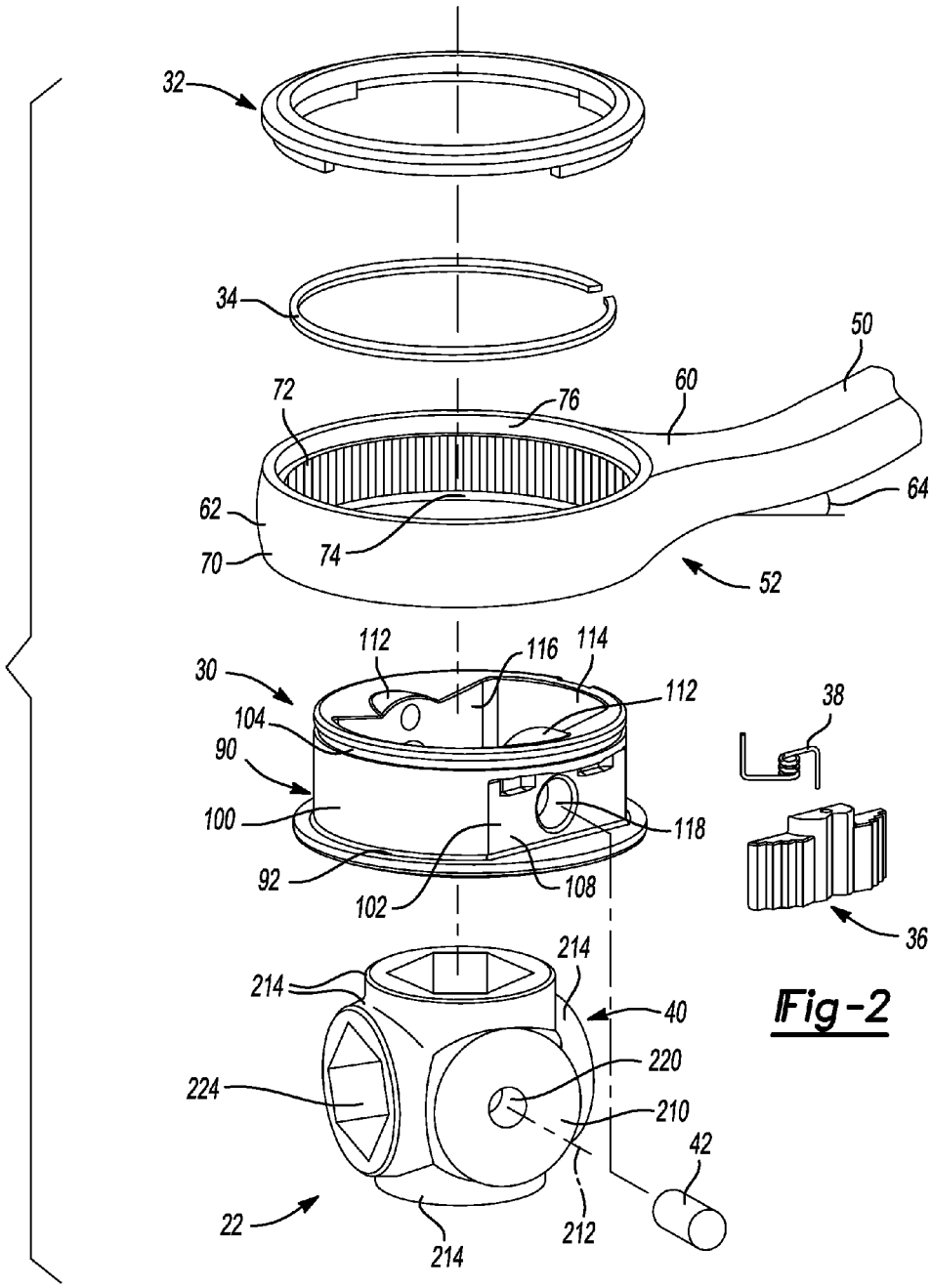
FIG. 2 is an exploded perspective view of the ratcheting wrench of FIG. 1.

With reference to FIGS. 1 and 2 of the drawings, a ratcheting wrench constructed in accordance with the teachings of the present disclosure is generally indicated by reference numeral 10. The ratcheting wrench 10 can comprise a handle structure 20 and a pair of ratchet assemblies 22. Each of the ratchet assemblies 22 can include a ratchet body 30, a selector ring 32, a retaining ring 34, at least one pawl 36, a pawl spring 38, a socket wheel 40 and one or more pivot pins 42.

The handle structure 20 can include a handle 50 and a pair of ratchet ends 52 that can be fixedly or fixedly but removably coupled to the opposite axial ends of the handle 50. Each ratchet end 52 can comprise a neck 60 and a ratchet structure 62. The neck 60 can couple an end of the handle 50 to the ratchet structure 62 and can be employed to orient the ratchet structure 62 to the handle 50 at a predetermined angle. In the particular example provided, a plane in which the ratchet end 52 is oriented intersects a longitudinal axis of the handle 50 at an included angle 64 of about 15 degrees. It will be appreciated, however, that the included angle 64 could be smaller or larger if desired and that a compound offset may be employed in the alternative. The ratchet structure 62 can comprise a body 70, a plurality of ratchet teeth 72, a first counterbore 74 and a second counterbore 76. The body 70 can have an annular shape with an inside surface on which the ratchet teeth 72 are formed. The first and second counterbores 74 and 76 can be formed into the ratchet structure 62 on opposite sides of the ratchet structure 62.

The handle structure 20 can be formed of a plurality of discrete components that can be assembled together. For example, the handle structure 20 could be formed of a plastic or composite material that can be selected for one or more properties, such as strength, (light) weight, electrical conductivity (or the lack thereof), and/or magnetic susceptibility (or the lack thereof), whereas the ratchet ends 52 can be formed of an appropriate metal, such as steel, iron, titanium or aluminum. In the particular example provided, the handle structure 20 is drop forged from a billet of steel so that the handle structure 20 is unitarily formed and extremely robust. Subsequent machining operations can be employed to form or further define the first and second counterbores 74 and 76 and the ratchet teeth 72, after which the handle structure 20 can be heat treated and/or finished, for example with a rust-resistant finish, such as chrome, black oxide, black magnesium and/or paint, in a desired manner. In the present example, the first and second counterbores 74 and 76 are machined, the first ratchet teeth 72 are broached, the handle structure 20 is heat treated, paint is applied to the exterior surface of the handle structure 20 via an e-coat process, a portion of the cured e-coat is subsequently removed from a predetermined area 80, a set of information 82 is etched into the predetermined area, and a clear paint or varnish is applied to the predetermined area to protect the set of information 82 and to provide corrosion resistance for the predetermined area and to permit users of the ratcheting wrench 10 to easily identify the present handle structure 20 is formed of metal. The set of information 82 can include any desired information, such as a decimal equivalent chart for various sized fasteners, and/or a listing of the sizes of the various fasteners that are suited for use with the ratcheting wrench 10.

Figure 3:
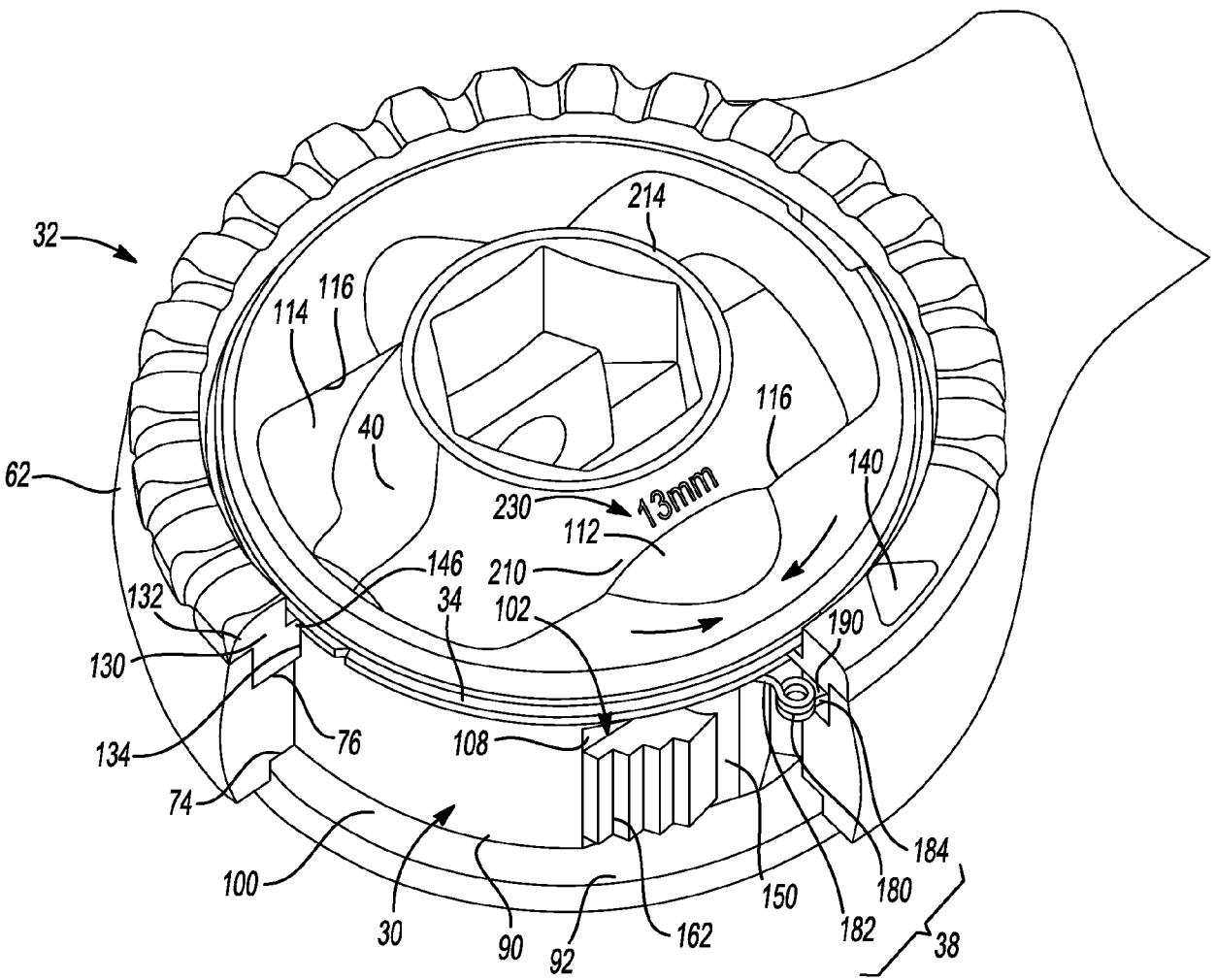
FIG. 3 is a perspective, partly sectioned view of a portion of the ratcheting wrench of FIG. 1.

With reference to FIGS. 2 and 3, the ratchet body 30 can include a body portion 90 and a flange portion 92. The ratchet body 30 can be formed of an appropriate material, such as steel, and can be unitarily formed in a desired manner, such as investment casting. The body portion 90 can have a generally annular outer surface 100 into which a pawl pocket 102 and a retaining groove 104 can be formed. The pawl pocket 102 can define a first abutment surface 108. The retaining groove 104 can extend around the body portion 90 proximate a first axial end of the ratchet body 30. The body portion 90 can define a pair of yokes 112 and a slotted interior aperture 114 having generally flat sidewalls 116. The yokes 112 can be disposed on opposite sides of the slotted interior aperture 114 and can define respective pin apertures 118. The flange portion 92 can be coupled to the body portion 90 on an axial end opposite the retaining groove 104. The ratchet body 30 can be received in an associated one of the ratchet ends 52 such that the body portion 90 is received within the ratchet teeth 72, the flange portion 92 is received in the first counterbore 74 and the retaining groove 104 is disposed axially above the second counterbore 76.

The selector ring 32 can define an annular ring body 130, an exterior annular lip 132 and an interior annular lip 134. The annular ring body 130 can be configured to be received in the second counterbore 76 between the ratchet structure 62 and the body portion 90 of the ratchet body 30. The exterior annular lip 132 can overlie and shroud a surface of the ratchet structure 62 that surrounds the second counterbore 76. The exterior annular lip 132 and/or an upper exterior surface of the ring body 130 can be contoured as desired to permit the selector ring 32 to be more easily and/or comfortably operated by a user of the ratcheting wrench 10 and/or to provide indicium 140 that can cooperate with indicia 142 (FIG. 1) on the ratchet body 30 to indicate a position or setting of the selector ring 32 and a manner in which the ratchet assembly 22 (FIG. 1) will operate. Accordingly, it will be appreciated that various ridges and grooves may be formed into the selector ring 32 and/or that a resilient material may be adhesively or cohesively (e.g., overmolded onto) a remaining portion of the selector ring 32. For example, the selector ring 32 could employ a main or structural portion that is net formed of aluminum in a die-casting operation and is overmolded with a thermoplastic to form the outer (upper) exterior surfaces of the selector ring 32 that are to be touched or grasped by a user of the ratcheting wrench 10. The interior annular lip 134 can be disposed on an end of the ring body 130 opposite the exterior annular lip 132 and can extend around all or portions of the circumference of the ring body 130. The interior annular lip 134 can define a shoulder 146 that can be disposed in alignment with the retaining groove 104 in the body portion 90 of the ratchet body 30. The ring body 130 and/or the interior annular lip 134 can be contoured in a desired manner to permit the selector ring 32 to be rotated relative to the ratchet body 30 by a predetermined amount, after which the selector ring 32 will rotate with the ratchet body 30. Depending on the configuration of the at least one pawl 36 and the pawl spring 38, various windows and/or cam features may be formed in or on the selector ring 32 to coordinate movement of the pawl spring 38 and/or the at least one pawl 36 to control the operation of the at least one pawl 36.

The retaining ring 34 can be an external snap ring and can be received into the retaining groove 104 and extend radially outwardly therefrom so as to overlie the interior annular lip 134, which can interlock the ratchet body 30 and the selector ring 32 to the ratchet structure 62. It will be appreciated that the retaining ring 34, the ratchet body 30 and the selector ring 32 cooperate to confine the ratchet body 30 and the selector ring 32 to the ratchet structure 62 (i.e., so that neither the ratchet body 30 nor the selector ring can be withdrawn from the ratchet structure 62).

Figure 4:
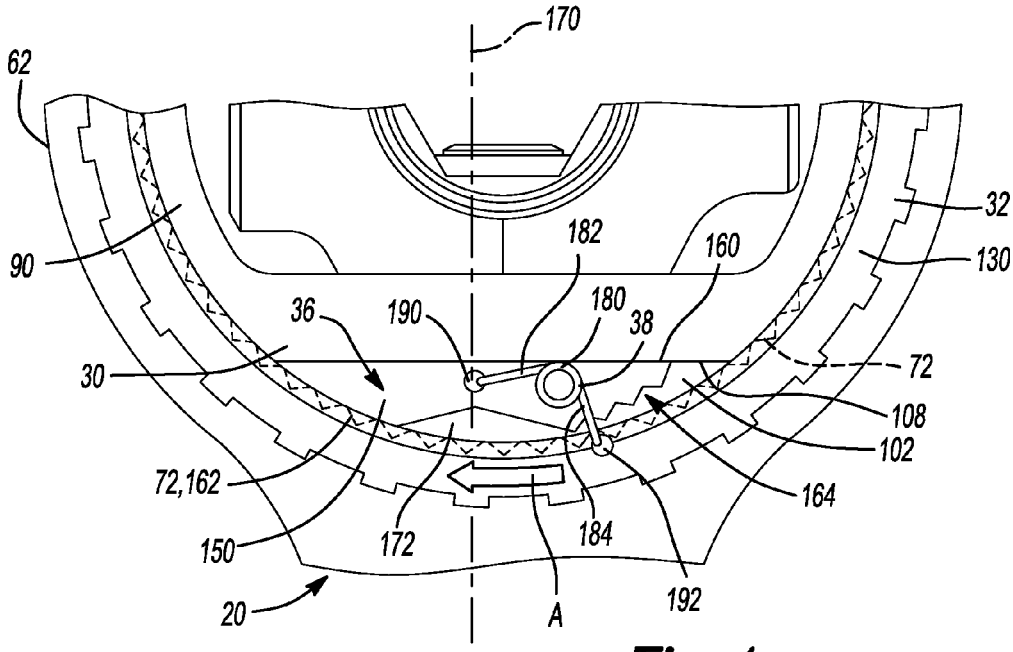
FIG. 4 is a top plan, partly sectioned view of a portion of the ratcheting wrench of FIG. 1 illustrating a pawl member in a first position.

With reference to FIGS. 3 and 4, the at least one pawl 36 may comprise a single pawl member 150 that can be received in the pawl pocket 102 radially between the body portion 90 of the ratchet body 30 and the ratchet teeth 72 so as to rotate with the ratchet body 30 relative to the ratchet structure 62. The pawl member 150 can be formed in any desired manner, but in the example provided, is formed via metal injection molding, which permits it to be net formed despite its relatively intricate features, and is thereafter heat treated. The pawl member 150 can define a second abutment surface 160, a first set of pawl teeth 162 and a second set of pawl teeth 164. The pawl member 150 can be received into the pawl pocket 102 such that the second abutment surface 160 is slidingly abutted against the first abutment surface 108. Each of the first and second sets of pawl teeth 162 and 164 can comprise one or more teeth. The first set of pawl teeth 162 can be mirrored about a mirror axis 170 such that the second set of pawl teeth 164 are mirror images of and circumferentially offset from the first set of pawl teeth 162 to thereby define an angular segment 172 therebetween. As will be described in more detail below, the pawl member 150 can be translated in the pawl pocket 102 between a first position (FIG. 4), in which the first set of pawl teeth 162 are engaged to the ratchet teeth 72 to prevent rotation of the ratchet body 30 relative to the ratchet structure 62 in a first rotational direction, and a second position (FIG. 6) in which the second set of pawl teeth 164 are engaged to the ratchet teeth 72 to inhibit rotation of the ratchet body 30 relative to the ratchet structure 62 in a second, opposite rotational direction. If desired, the pawl member 150 may be movable in a direction away from the first abutment surface 108 to permit both the first and second sets of pawl teeth 162 and 164 to be engaged with the ratchet teeth 72 to inhibit rotation of the ratchet body 30 relative to the ratchet structure 62 in both rotational directions.

The pawl spring 38 can be configured to bias the at least one pawl 36 into engagement with the ratchet teeth 72. In the particular example provided, the pawl spring 38 is a torsion spring having a coiled spring body 180, a first leg 182 and a second leg 184. The first leg 182 can be coupled to a first end of the coiled spring body 180 and can be received into a first leg aperture 190 formed into the pawl member 150 at a location that is disposed along the mirror axis 170. The second leg 184 can be coupled to a second, opposite end of the coiled spring body 180 and can be received into a second leg aperture 192 formed into the ring body 130 of the selector ring 32. Depending on the position of the selector ring 32 relative to the ratchet body 30 (and the pawl member 150), the pawl spring 38 can be configured to bias one of the first and second sets of pawl teeth 162 and 164 into engagement with the ratchet teeth 72, as well as to permit relative movement (i.e., translation of the pawl member 150 relative to the ratchet body 30) to permit rotation of the ratchet structure 62 relative to the ratchet body 30 in a predetermined rotational direction.

As shown in FIG. 4, the selector ring 32 is disposed in a first setting (rotary) position relative to the ratchet body 30, which causes the pawl spring 38 to apply a force to the pawl member 150 that biases the first set of pawl teeth 162 into engagement with the ratchet teeth 72 and spaces the second set of pawl teeth 164 apart from the ratchet teeth 72. Accordingly, when the handle structure 20 is rotated in the direction of arrow A, the ratchet teeth 72 apply a force to the first set of pawl teeth 162 that tends to urge the pawl member 150 against the first abutment surface 108 and toward the ratchet teeth 72 so that the first set of pawl teeth 162 are effectively locked to the ratchet teeth 72. When the handle structure 20 is rotated in a direction opposite that of arrow A, the ratchet teeth 72 apply a force to the first set of pawl teeth 162 that tends to urge the pawl member 150 away from the ratchet teeth 72 against the bias of the pawl spring 38 to permit the first set of pawl teeth 162 to disengage the ratchet teeth 72.

To change the ratcheting direction, the selector ring 32 is first moved through an intermediate setting position (shown in FIG. 5) to a second setting position (shown in FIG. 6) relative to the ratchet body 30.

Figure 5:
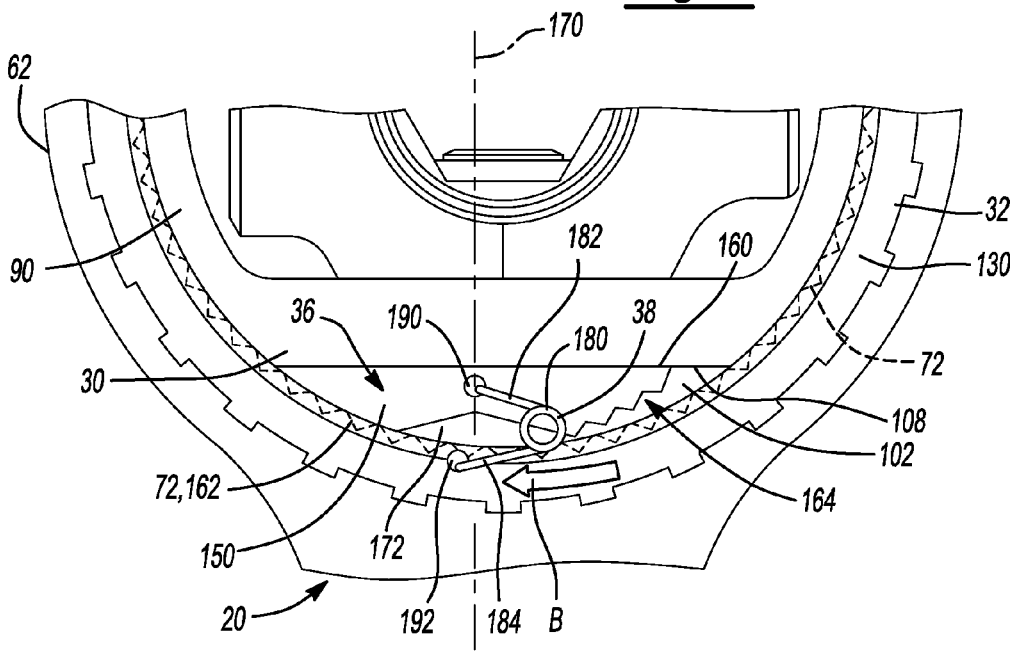
FIGS. 5 and 6 are views that are similar to that of FIG. 4, but depicting the pawl member in an intermediate position and a second position, respectively.

In FIG. 5, rotation of the selector ring 32 from the first setting position to the intermediate position in the direction of arrow B reduces the distance between the first and second legs 182 and 184 to a minimum distance, which is associated with a maximum output torque of the pawl spring 38. It will be appreciated that further rotation of the selector ring 32 relative to the ratchet body 30 in the direction of arrow B will be assisted after this point by the pawl spring 38.

Figure 6:
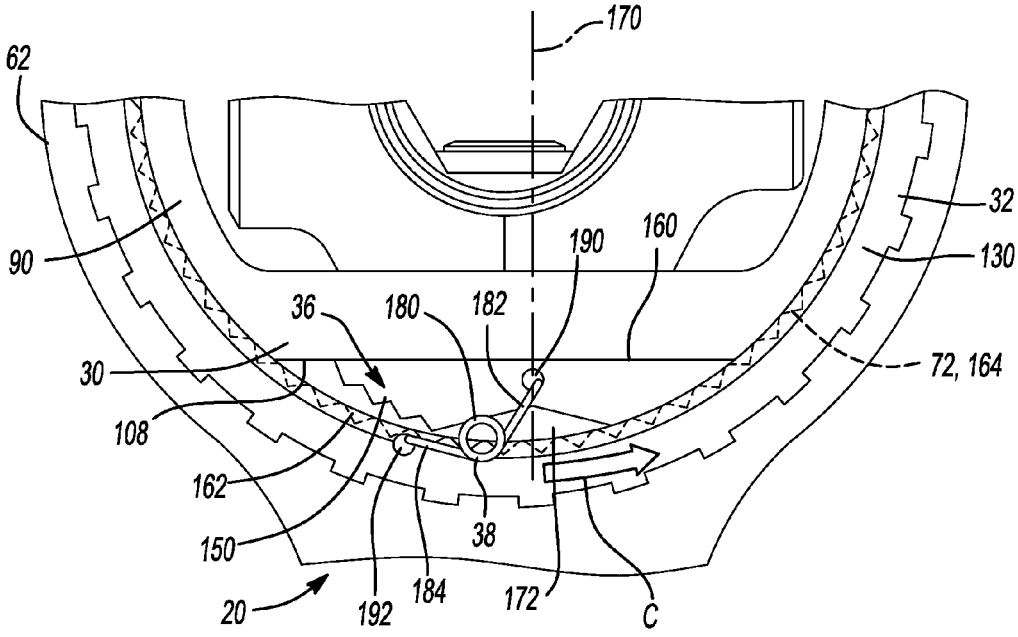

In FIG. 6, the selector ring 32 is in the second setting position relative to the ratchet body 30, which causes the pawl spring 38 to apply a force to the pawl member 150 that biases the second set of pawl teeth 164 into engagement with the ratchet teeth 72 and spaces the first set of pawl teeth 162 apart from the ratchet teeth 72. Accordingly, when the handle structure 20 is rotated in the direction of arrow C, the ratchet teeth 72 apply a force to the second set of pawl teeth 164 that tends to urge the pawl member 150 against the first abutment surface 108 and toward the ratchet teeth 72 so that the second set of pawl teeth 164 are effectively locked to the ratchet teeth 72. When the handle structure 20 is rotated in a direction opposite that of arrow C, the ratchet teeth 72 apply a force to the second set of pawl teeth 164 that tends to urge the pawl member 150 away from the ratchet teeth 72 against the bias of the pawl spring 38 to permit the second set of pawl teeth 164 to disengage the ratchet teeth 72.

In the particular example provided, the coiled spring body 180 and the second leg 184 can be positioned at various times within a volume bounded portions of the selector ring 32 (e.g., the ring body 130 and/or the interior annular lip 134). Accordingly, one or more spring windows 190 (see FIG. 3, which shows a single spring window) can be formed in the selector ring 32 to accommodate portions of the pawl spring 38 as necessary over the range of its movement.

It will be appreciated from the above discussion that in the particular example provided, the configuration of the pawl spring 38 provides the functionality of a detent to resist rotation of the selector ring 32 from the first position to the intermediate position and from the second position to the intermediate position.

Returning to FIG. 2, the socket wheel 40 can define a pair of rotary hubs 210, which can define a rotational axis 212, and a plurality of tool members 214 that can be coupled to and extend radially from the rotary hubs 210. The socket wheel 40 can be formed in any desired manner, but in the particular example provided, the socket wheel 40 is investment cast, heat treated, machined (e.g., broached) and nickel-chrome plated. The rotary hubs 210 can have a generally cylindrical shape and can define a pivot pin aperture 220 that is disposed about the rotational axis 212. In the example provided, the tool members 214 comprise a plurality of hollow cylindrical structures that are spaced circumferentially about the rotary hubs 210 so that each tool member 214 is fixedly coupled to two adjacent tool members 214 and to the rotary hubs 210. Each tool member 214 can define a desired tool or tool holder. In the example provided, four tool members 214 are provided and each tool member 214 has a differently sized hexagonal bore 224. It will be appreciated, however, that one or more of the tool members 214 may be shaped differently from that which is depicted here. Where a tool member 214 defines a female aperture or bore, it will be appreciated that the tool member 214 may be configured to receive one or more predetermined male shapes. For example, the female aperture can be configured with splines (see, e.g., U.S. Pat. No. 3,675,516), a square (four-point) bore, an octagonal (eight-point) bore, a dodecagonal (twelve-point) bore, a bore that is configured to engage the flanks of the head of a fastener (see, e.g., U.S. Pat. No. 5,219,392), or a bore that is configured to receive a fastener with a male hex or TOMO-shaped head. Where a tool member 214 is configured to engage one or more male shapes, the tool member 214 can include a correspondingly shaped female aperture.

With reference to FIG. 3, each tool member 214 can be marked with indicium 230 to identify its size. The indicium 230 can be formed in any desired manner and can be raised relative to the surrounding surface of the tool member 214 (e.g., cast onto), or recessed relative to the surrounding surface of the tool member 214 (e.g., cast, engraved, stamped or etched into). In the particular example provided, an intaglio process in which the indicium 230 is etched into the tool member 214 with acid, the etching is filled with an enamel paint and cured (e.g., baked).

With additional reference to FIG. 2, the socket wheel 40 can be received into the slotted interior aperture 114 in the ratchet body 30 such that each rotary hub 210 is abutted against or disposed proximate an associated one of the sidewalls 116. The at least one pivot pin 42 can be employed to rotatably couple the rotary hubs 210 to the yokes 112. In the example provided, a pair of pivot pins 42 are employed, each pivot pin 42 being received into a pivot pin aperture 220 formed in a corresponding one of the rotary hubs 210 and a corresponding one of the pin apertures 118 in the yokes 112. Each pivot pin 42 can be fixedly coupled to an associated one of the rotary hubs 210 (e.g., via an interference fit) and can be received in a slip-fit manner into the pin aperture 118 in an associated one of the yokes 112. It will be appreciated that other coupling means may be employed, such as threads, adhesives, and bonds or welds, and that the pivot pin(s) could be fixedly coupled to the ratchet body 30 and rotatably received in the pivot pin apertures 220. It will also be appreciated that where a single pivot pin is employed to rotatably couple the socket wheel 40 to the yokes 112, the single pivot pin could be fixedly coupled to only one of the rotary hubs 210 or to only one of the yokes 112.

As shown in FIG. 1, the socket wheel 40 is rotatable or pivotable about the rotational axis 212 defined by the rotary hubs 210 (for the selection of a desired tool member 214), as well as ratchet-able (rotatable) about a ratcheting axis 250 that is perpendicular to the rotational axis 212.

With brief reference to FIG. 2, it will be appreciated that the selector ring 34 does not need to rotate relative to the ratchet body 30 if the ratchet wrench 10 need not be configured to permit the user to change the engagement between the at least one pawl 36 and the ratchet teeth 72. Configuration in this manner may be appropriate, for example, in situations where no offset is employed between the neck 60 and the handle 50 so the user may simply flip from one side (e.g., the top side) to the other side (e.g., the bottom side) to control the rotational direction in which ratcheting of the handle 50 relative to the ratchet body 30 is permitted. Alternatively, a first one of the ratchet assemblies 22 can be configured to permit ratcheting of the handle 50 relative to the ratchet body 30 in a first rotational direction, while the other one of the ratchet assemblies 22 can be configured to permit ratcheting of the handle 50 relative to the ratchet body 30 in a second rotational direction.

Those of ordinary skill in the art will appreciated from the above discussion that the ratchet teeth 72, the at least one pawl 36 and the pawl spring 38 can cooperate to form a portion of a one-way clutch (e.g., a ratchet clutch) that may be operated in one or modes to control rotation of the ratchet body 30 relative to the ratchet structure 62 and that such modes may include: rotation in a first rotational direction; rotation in a second, opposite rotational direction; and/or locking the ratchet body 30 to the ratchet structure 62 to inhibit relative rotation therebetween. Furthermore, while the ratchet teeth 72 have been illustrated and described as being formed on the ratchet structure, and while the at least one pawl 36 and pawl spring 38 have been described as being mounted on the ratchet body 30, it will be appreciated that the ratchet teeth 72 could be formed about the body portion 90 of the ratchet body 30 and that one or both of the at least one pawl 36 and the pawl spring 38 could be mounted on the ratchet structure 62 in the alternative.

It will be appreciated, however, that other types of one-way clutches could be substituted for the ratchet clutch that is employed in the example of FIG. 1. For example, a roller clutch can be employed as is depicted in FIG. 26. In this example, the at least one pawl 36' is a roller that is biased by the pawl spring 38' into engagement with an annular inner surface 900 of the ratchet structure 62' and the first abutment surface 108' of the ratchet body 30'. Rotation of the ratchet structure 62' (relative to the ratchet body 30') in the direction of arrow W can pinch the at least one pawl 36' (which comprises a single, cylindrically-shaped roller in the example provided) between the internal annular surface 900 and the first abutment surface 108' to rotationally lock the ratchet structure 62' and the ratchet body 30'. Rotation of the ratchet structure 62' (relative to the ratchet body 30') in a direction opposite that of arrow W will open the space between the internal annular surface 900 and the first abutment surface 108' to permit the at least one pawl 36' to roll or slide along the interior annular surface 900 such that the ratchet structure 62' may be rotated relative to the ratchet body 30'. In the present example, the one-way clutch is uni-directional (i.e., non-reversable) and consequently, the ratcheting wrench 10'would need to be rotated 180° about the longitudinal axis of the handle structure 20' to change the ratcheting (rotational) direction.

In the example of FIGS. 27 and 28, a similar ratcheting wrench is illustrated to include a reversible one-way clutch that can include a selector ring 32" that is coupled to an end of the pawl spring 38" opposite the at least one pawl 36". In the example provided, the pawl spring 36" is a torsion spring having a first end 920 onto which the at least one pawl 36" is mounted, and a second end 922 that is mounted to the selector ring 32". The selector ring 32" can be rotated to selective orient the pawl spring 38" to change the manner in which the at least one pawl 36" is biased. In the orientation shown in FIG. 27, the pawl spring 38" biases the at least one pawl 36" relative to the annular interior surface 900 and the first abutment surface 108" in a manner that permits rotation of the ratchet structure 62" relative to the ratchet body 30" in a direction that is opposite the direction of arrow X and inhibits rotation of the ratchet structure 62" relative to the ratchet body 30" in the direction of arrow X. In the orientation shown in FIG. 28, the pawl spring 38" biases the at least one pawl 36" relative to the annular interior surface 900 and the first abutment surface 108" in a manner that permits rotation of the ratchet structure 62" relative to the ratchet body 30" in a direction opposite the direction of arrow Y and inhibits rotation of the ratchet structure 62" relative to the ratchet body 30" in the direction of arrow Y.

Figure 7:
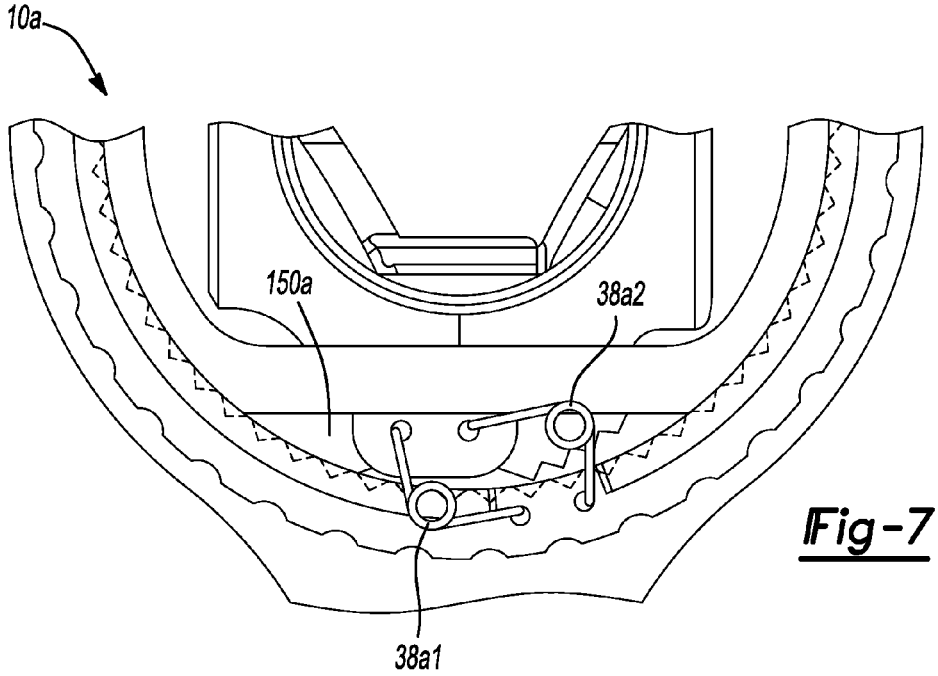
FIG. 7 is a top plan, partly sectioned view of a portion of another ratcheting wrench constructed in accordance with the teachings of the present disclosure illustrating a pawl member in a first position.
Figure 8:
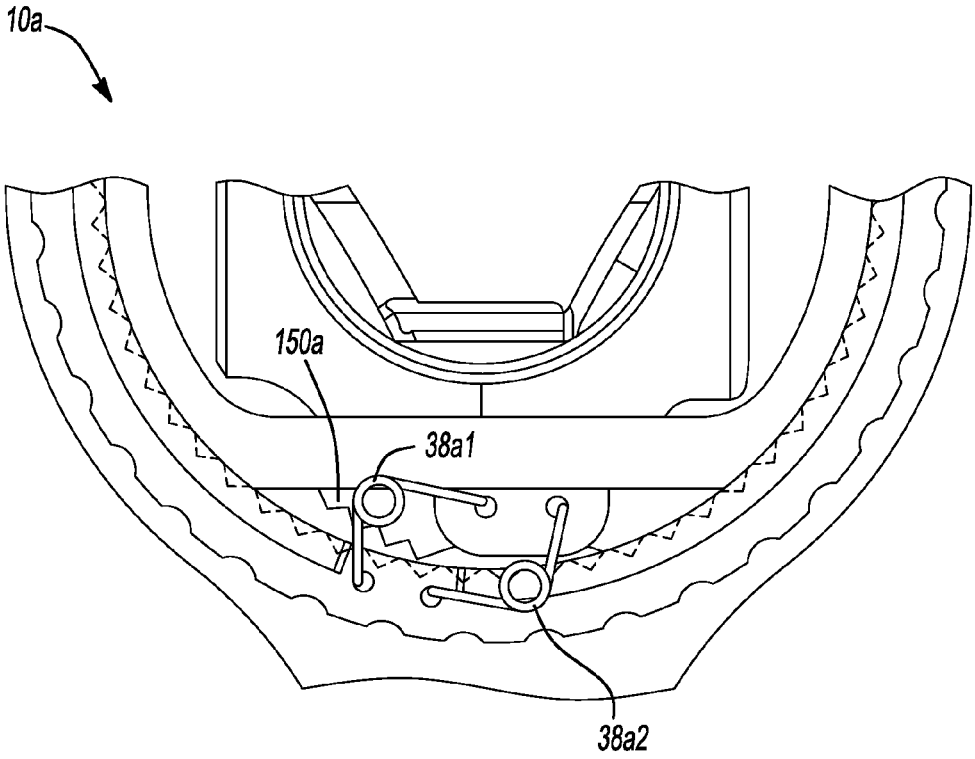
FIG. 8 is a view that is similar to that of FIG. 7, but depicting the pawl member in a second position.

With reference to FIGS. 7 and 8, a portion of another ratcheting wrench 10*a* constructed in accordance with the teachings of the present disclosure is illustrated. Except as otherwise described herein, the ratcheting wrench 10*a* can be generally similar to the ratcheting wrench 10 of FIG. 1. In this example, the pawl spring comprises a pair of torsion springs (i.e., first pawl spring 38*a*1 and a second pawl spring 38*a*2) for selectively biasing the pawl member 150*a* into the first position (FIG. 7) and the second position (FIG. 8).

Figure 9:
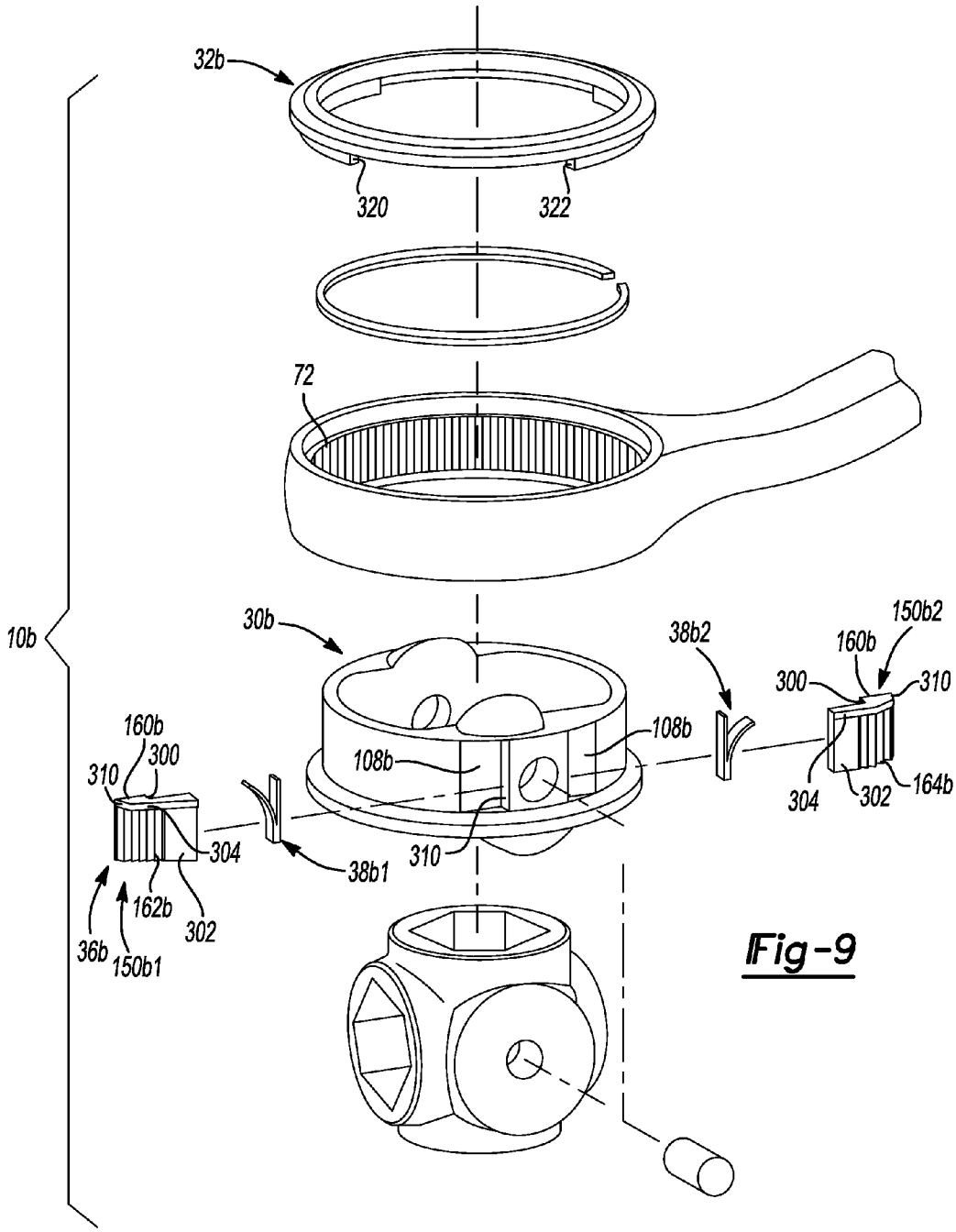
FIG. 9 is an exploded perspective view of a portion of another ratcheting wrench constructed in accordance with the teachings of the present disclosure.
Figure 10:
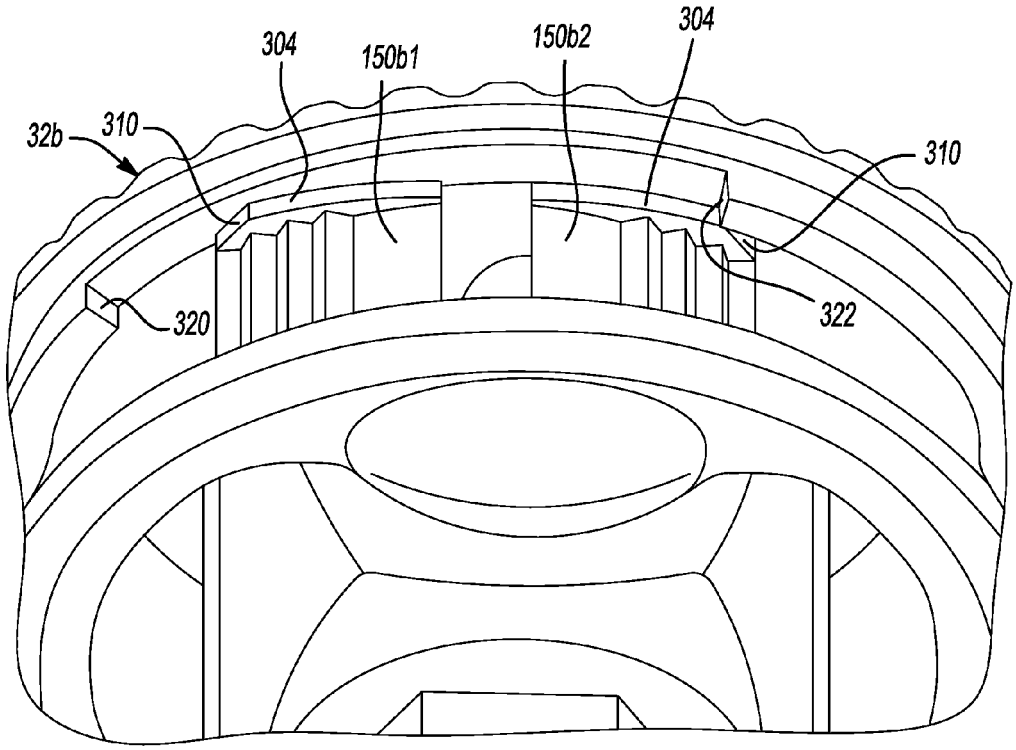
FIG. 10 is a perspective view of a portion of the ratcheting wrench of FIG. 9, illustrating a selector ring, a ratchet body and a pair of pawl members in more detail.

With reference to FIGS. 9 and 10, a portion of another ratcheting wrench 10*b* constructed in accordance with the teachings of the present disclosure is illustrated. Except as otherwise described herein, the ratcheting wrench 10*b* can be generally similar to the ratcheting wrench 10 of FIG. 1. In this example, the at least one pawl 36*b* comprises two pawl members 150*b*1 and 150*b*2 and the pawl spring comprises a pair of springs 38*b*1 and 38*b*2, each of which being configured to bias the pawl members 150*b*1 and 150*b*2, respectively, radially outwardly from the ratchet body 30*b*. The springs 38*b*1 and 38*b*2 can be any type of spring, such as a compression spring, but are depicted as being leaf springs in the example provided. Because the pawl members 150*b*1 and 150*b*2 are mirror images of one another, only the pawl member 150*b*1 will be described in detail herein. The pawl member 150*b*1 can be a generally L-shaped structure that can define a set of pawl teeth 162*b*, which are configured to selectively engage the ratchet teeth 72, a second abutment surface 160*b*, which is configured to slidingly abut a first abutment surface 108*b* formed on the ratchet body 30*b*, a spring abutment surface 300, a front wall member 302 and a pawl actuation member 304. The spring abutment surface 300 and the front wall member 302 can cooperate with the ratchet body 30*b* to confine the spring 38*b*1 between the ratchet body 30*b* and the pawl member 150*b*1. More specifically, the spring 38*b*1 can be received between a spring wall 310 formed on the ratchet body 30*b* and the spring abutment surface 300 such that the spring 38*b*1 biases the pawl member 150*b*1 in a radially outward direction from the ratchet body 30*b*. The front wall member 302 can be employed to maintain the spring 38*b*1 in its position between the spring wall 310 and the spring abutment surface 300. The pawl actuation member 304 can comprise a rib-like projection that can extend outwardly from the set of pawl teeth 162*b* and the front wall member 302 and which can terminate at a cam surface 310. The selector ring 32*b* can be configured with a first and second mating cam surfaces 320 and 322, respectively, that can be selectively engaged to the cam surfaces 310 of the pawl members 150*b*1 and 150*b*2, respectively.

Figure 11:
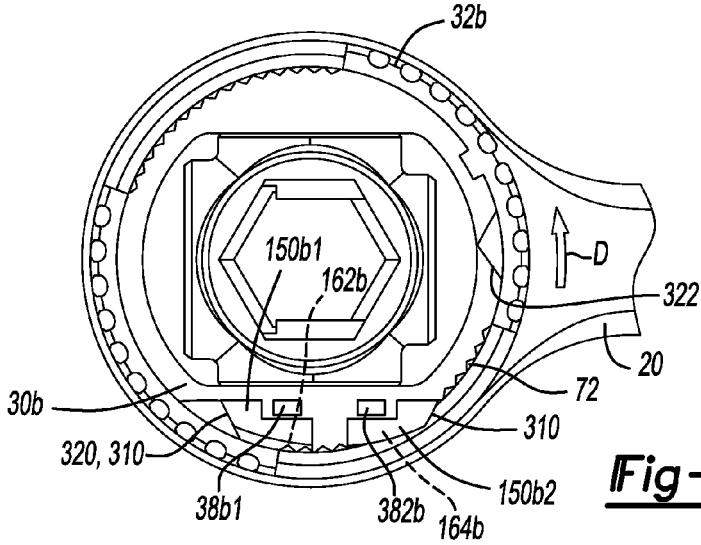
FIGS. 11, 12 and 13 are top plan, partly sectioned views of a portion of the ratcheting wrench of FIG. 9 illustrating a setting ring in a first setting position, a second setting position and a third setting position, respectively.

In FIG. 11, the selector ring 32*b* is rotated to a first setting position in which the first mating cam surface 320 contacts the cam surface 310 of the pawl member 150*b*1, which drives the pawl member 150*b*1 inwardly toward the ratchet body 30*b* such that the pawl teeth 162*b* are disengaged from the ratchet teeth 72. The second mating cam surface 322, however, is rotated out of engagement with the cam surface 310 of the pawl member 150*b*2 so that the spring 38*b*2 can bias the pawl teeth 164*b* of the pawl member 150*b*2 into engagement with the ratchet teeth 72. When the handle structure 20 is rotated in the direction of arrow D, the ratchet teeth 72 apply a force to the set of pawl teeth 164*b* that tends to urge the pawl member 150*b*2 against the first abutting surface 108*b* (FIG. 9) and toward the ratchet teeth 72 so that the set of pawl teeth

164*b* are effectively locked to the ratchet teeth 72. When the handle structure 20 is rotated in a direction opposite that of arrow D, the ratchet teeth 72 apply a force to the set of pawl teeth 164*b* that tends to urge the pawl member 150*b*2 away from the ratchet teeth 72 against the bias of the spring 38*b*2 to permit the set of pawl teeth 164*b* to disengage the ratchet teeth 72.

Figure 12:
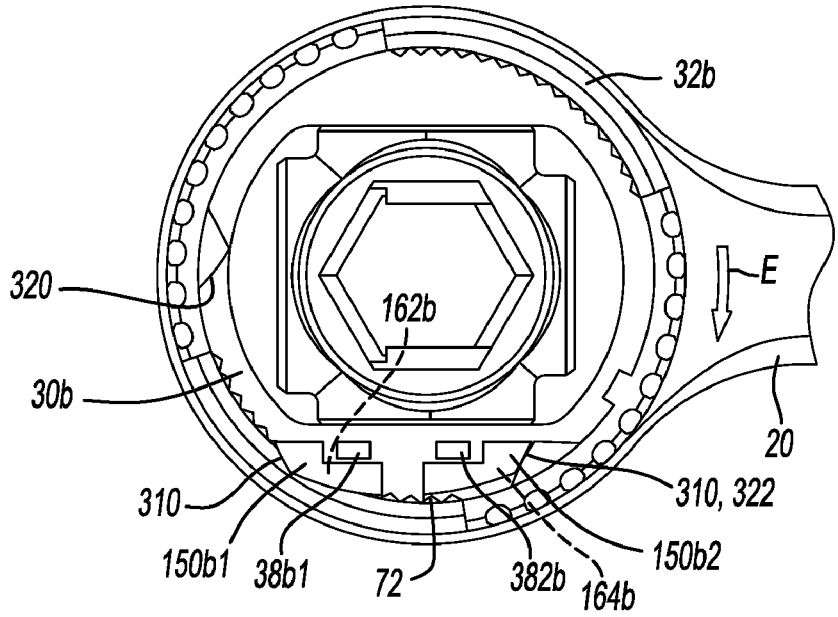

In FIG. 12, the selector ring 32*b* is rotated to a second setting position in which the second mating cam surface 322 contacts the cam surface 310 of the pawl member 150*b*2, which drives the pawl member 150*b*2 inwardly toward the ratchet body 30*b* such that the pawl teeth 164*b* are disengaged from the ratchet teeth 72. The first mating cam surface 320, however, is rotated out of engagement with the cam surface 310 of the pawl member 150*b*1 so that the spring 38*b*1 can bias the pawl teeth 162*b* of the pawl member 150*b*1 into engagement with the ratchet teeth 72. When the handle structure 20 is rotated in the direction of arrow E, the ratchet teeth 72 apply a force to the set of pawl teeth 162*b* that tends to urge the pawl member 150*b*1 against the first abutting surface 108*b* (FIG. 9) and toward the ratchet teeth 72 so that the set of pawl teeth 162*b* are effectively locked to the ratchet teeth 72. When the handle structure 20 is rotated in a direction opposite that of arrow E, the ratchet teeth 72 apply a force to the set of pawl teeth 162*b* that tends to urge the pawl member 150*b*1 away from the ratchet teeth 72 against the bias of the spring 38*b*1 to permit the set of pawl teeth 162*b* to disengage the ratchet teeth 72.

Figure 13:
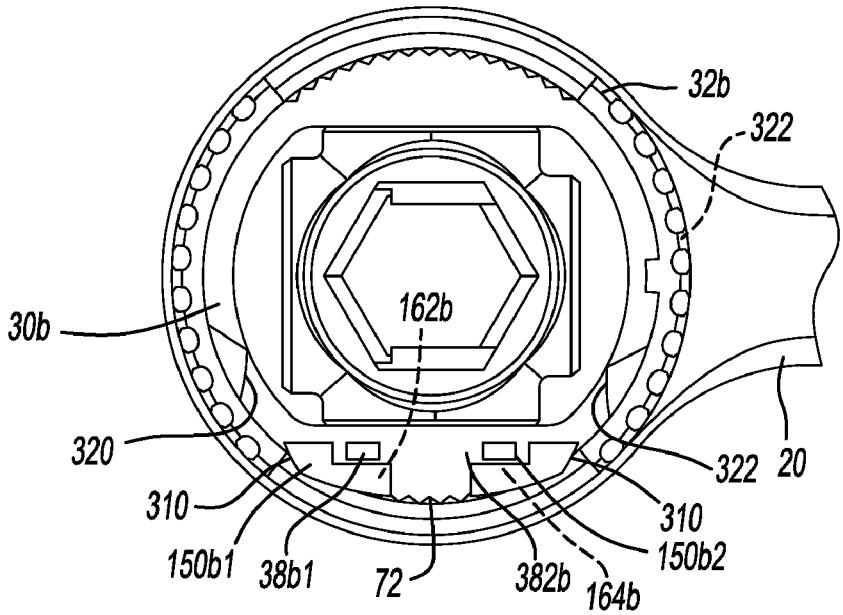

In FIG. 13, the selector ring 32*b* is rotated to a third setting position, which may be intermediate the first and second setting positions, in which the first and second mating cam surfaces 320 and 322 are disengaged from the cam surfaces 310 of the pawl members 150*b*1 and 150*b*2, respectively. Accordingly, the springs 38*b*1 and 38*b*2 bias the pawl members 150*b*1 and 1*b*2 outwardly from the ratchet body 30*b* such that the sets of pawl teeth 162*b* and 164*b* are engaged to the ratchet teeth 72, which effectively inhibits rotation of the ratchet body 30*b* relative to the ratchet structure 62 in either rotational direction.

Figure 14:
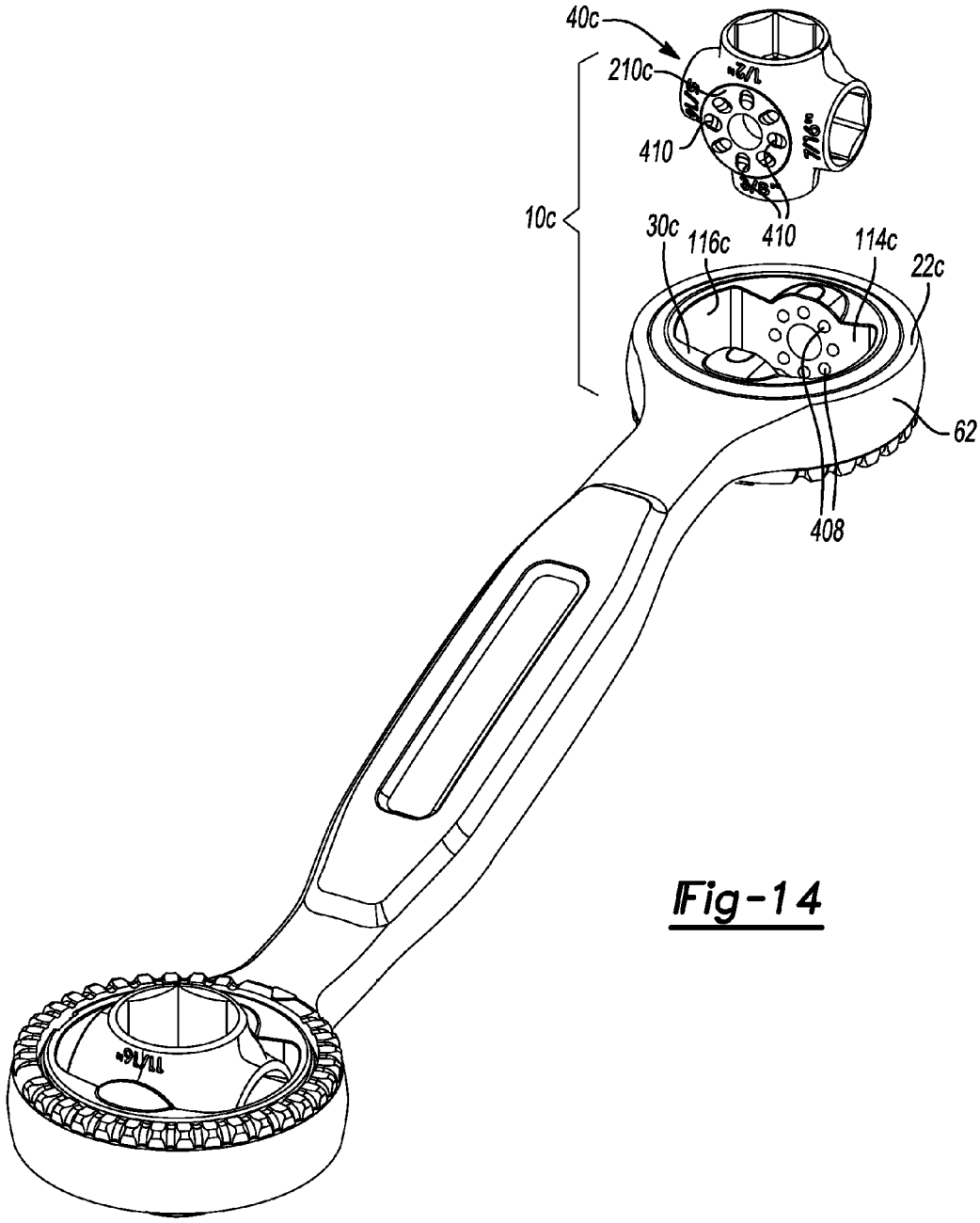
FIG. 14 is an exploded perspective view of another ratcheting wrench constructed in accordance with the teachings of the present disclosure.

With reference to FIG. 14, a portion of another ratcheting wrench 10*c* constructed in accordance with the teachings of the present disclosure is illustrated. Except as otherwise described herein, the ratcheting wrench 10*c* can be generally similar to the ratcheting wrench 10 of FIG. 1. In this example, the socket wheel 40*c* is configured to be removable from a remainder of the ratchet assembly 22*c* to provide increased flexibility. In the example provided, the ratchet assembly 22*c* does not employ at least one pivot pin 42 (FIG. 2) but rather employs two sets of spring detent pins 408, with each set of detents being configured to engage corresponding detent recesses 410 formed in the rotary hubs 210*c* of the socket wheel 40*c*. It will be appreciated that the slotted interior aperture 114*c* in the ratchet body 30*c* can be sized such that there is relatively little clearance between the sidewalls 116*c* and the axial ends of the rotary hubs 210*c*. Additionally or alternatively, a pivot pin (not shown) may be inserted through a hole (not shown) in the ratchet structure 62 and into apertures in the yokes and rotary hubs 210*c*.

Figure 15:
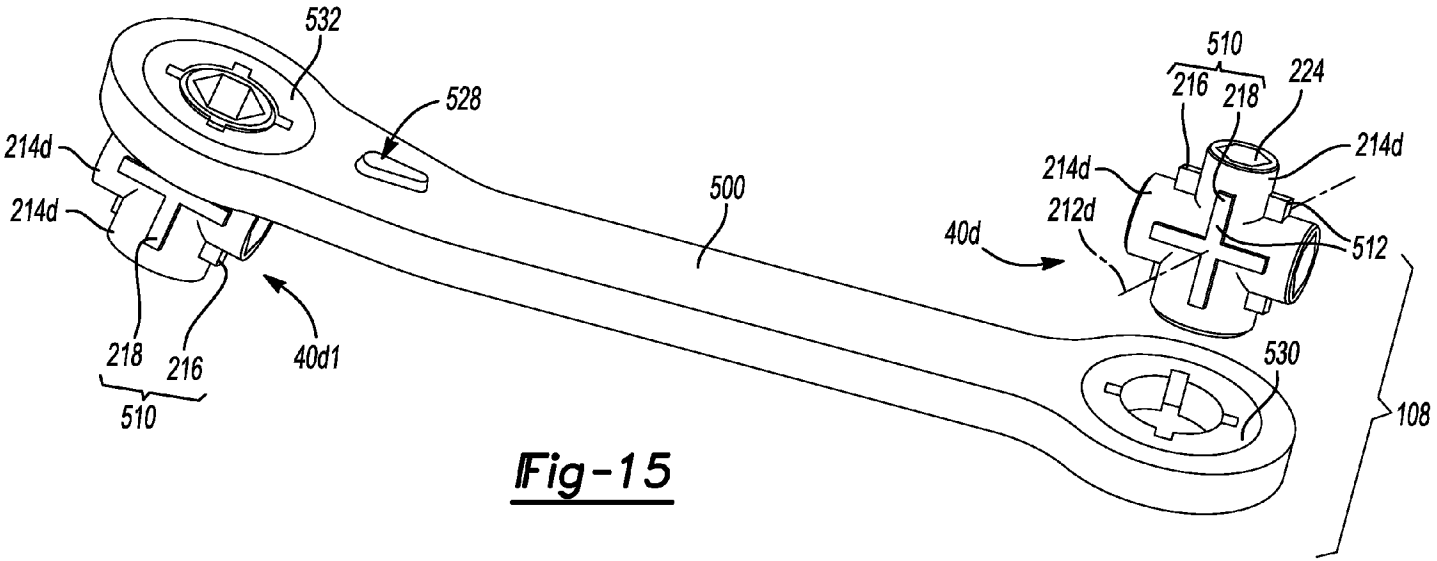
FIG. 15 is an exploded perspective view of another ratcheting wrench constructed in accordance with the teachings of the present disclosure.

With reference to FIG. 15 of the drawings, another ratcheting wrench 10*d* constructed in accordance with the teachings of the present disclosure is illustrated. The ratcheting wrench 10*d* can comprise a handle and ratchet assembly 500 and first and second socket wheels 40*d* and 40*d*1, respectively.

The socket wheels 40*d* and 40*d*1 can be generally similar to the socket wheels 40 (FIG. 2) described above, except that they need not include the rotary hubs 210 (FIG. 2). As the socket wheels 40*d* and 40*d*1 are generally similar (except for their size), only the socket wheel 40*d* will be described in detail. The socket wheel 40*d* can define a plurality of tool members 214*d* that can be coupled to one another and extend radially outwardly from a central axis 212*d*. If desired, the tool members 214*d* can be coupled to tool members 214*d* that are disposed on a side across the central axis 212*d* as shown (e.g., for improved strength), or an aperture could be formed through the socket wheel 40*d* along the central axis 212*d* to reduce the weight of the socket wheel 40*d*. The socket wheel 40*d* can be formed in any desired manner, but in the particular example provided, the socket wheel 40*d* is investment cast, heat treated, machined (e.g., broached) and nickel-chrome plated. In the example provided, the tool members 214*d* comprise a plurality of hollow cylindrical structures that are spaced circumferentially about the central axis 212*d* so that each tool member 214*d* is fixedly coupled to two adjacent tool members 214*d*. Each tool member 214*d* can define a desired tool or tool holder. In the example provided, four tool members 214*d* are provided and each tool member 214*d* has a differently sized hexagonal bore 224. It will be appreciated, however, that one or more of the tool members 214*d* may be shaped differently from that which is depicted here. A plurality of driving features 510 can be formed into or onto the exterior of each of the tool members 214*d*. In the example provided, the driving features 510 comprise two pair of lugs 512 that are evenly spaced about the circumference of the tool member 214*d*, where a first pair 516 of the lugs 512 are nominally disposed within a first plane that is perpendicular to the central axis 212*d* and which bisects the socket wheel 40*d*, and a second pair 218 of the lugs 512 are nominally disposed in a second plane that includes the central axis 212*d* and which is perpendicular to the first plane. Configuration in this manner permits a portion of the lugs 512 (e.g., one or the other of the first pair 216 of lugs 512) to be shared between adjacent tool members 214*d*. It will be appreciated that various other types of driving features could be employed. For example, a portion of the exterior surface of each tool member 214*d* could conform to a predetermined geometric shape, e.g., a square or hex-shape of a predetermined size.

The handle and ratchet assembly 500 can be generally similar to a commercially available ratcheting box wrench. For example the handle and ratchet assembly 500 can be generally similar to a R2022C ratcheting box wrench that is commercially available from Snap-On Inc. of Kenosha, Wisconsin or a BORXM 1919 ratcheting box wrench that is commercially available from Snap-On Inc. of Kenosha, Wisconsin and as such, may or may not have a selector 528 for controlling the operation and engagement of the pawl(s) (not shown). Those of skill in the art will appreciate from this disclosure that if a selector lever is not employed such that the direction of the ratchet assembly 500 is not reversible, the user could flip the handle and ratchet assembly 500 such that the socket wheel 40*d* is driven from the opposite side. The handle and ratchet assembly 500, however, can be equipped with a pair of drive members 530 and 532 that are configured to drivingly engage the socket wheels 40*d* and 40*d*1, respectively. In the example provided, the socket wheel 40*d*1 is larger than the socket wheel 40*d* and as such, the drive member 532 is larger than the drive member 530. Each drive member 530 and 532 can be sized and shaped to drivingly engage the driving features 510 of an associated one of the socket wheels 40*d* and 40*d*1. In the particular example provided, the driving features 510 are configured to engage an associated one of the drive members 530 and 532 in a slip-fit manner, but it will be appreciated that a detent mechanism (not shown) could be integrated into the socket wheels 40*d* and 40*d*1 and the drive members 530 and 532 to permit the socket wheels 40*d* and 40*d*1 to be fixedly but removably coupled to the drive members 530 and 532, respectively.

Figure 16:
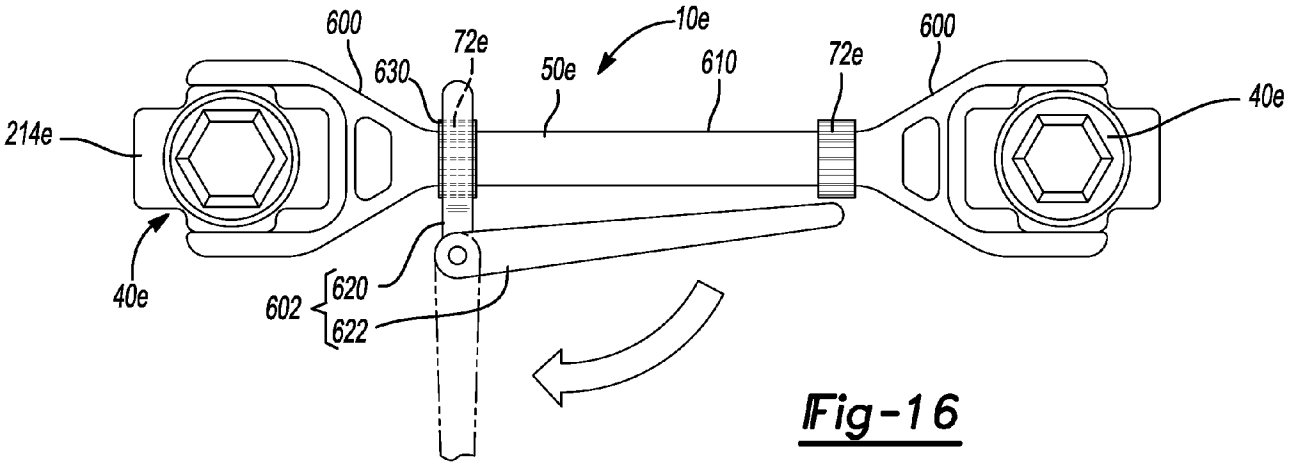
FIG. 16 is a perspective view of another ratcheting wrench constructed in accordance with the teachings of the present disclosure.

With reference to FIG. 16, a portion of another ratcheting wrench 10*e* constructed in accordance with the teachings of the present disclosure is illustrated. The ratcheting wrench 10*e* can include a handle 50*e*, a pair of yokes 600, a pair of socket wheels 40*e* and a ratcheting mechanism 602. The handle 50*e* can be configured with a central section 610 and a desired quantity of sets of ratchet teeth 72*e*. In the particular example provided, two sets of ratchet teeth 72*e* are employed (at opposite ends of the central section 610). Each set of ratchet teeth 72*e* can have a root diameter that can be larger than the size of the central section 610. It will be appreciated the sets of ratchet teeth 72*e* can have more or fewer teeth than that which is shown here (e.g., each set of ratchet teeth 72*e* could have a square or hexagonal shape). The yokes 600 can be fixedly coupled to the opposite ends of the handle 50*e*. Alternatively, at least one of the yokes 600 can be removably coupled to the handle 50*e* and depending on the configuration of the interface between the handle 50*e* and the yokes 600, the ratcheting wrench 10*e* could be configured to provide additional flexibility. For example, the ratcheting mechanism 602 could be directly coupled to one of the yokes 600; the ratcheting mechanism 602 could be employed to drive one of the yokes 600 through the handle 50*e* when the other one of the yokes 600 is removed from the handle 50*e*; the ratcheting mechanism 602 and optionally one of the yokes 600 could be removed from the handle 50*e* so that the remainder of the ratcheting wrench 10*e* could be employed without the ratcheting mechanism 602. The socket wheels 40*e* can be generally similar to the socket wheel 40 (FIG. 2) and can be coupled to an associated one of the yokes 600 via at least one or two pivot pins (not shown).

The ratcheting mechanism 602 can comprise a ratchet head 620 and an auxiliary handle 622, which can be pivotally mounted to the ratchet head 620. Generally, the ratcheting mechanism 602 can be similar to a flex-head ratcheting box end wrench that is commercially available from a variety of sources (e.g., a BOERF22A flex head ratcheting box end wrench that is commercially available from Snap-On Inc. of Kenosha, Wisconsin). The ratchet head 620 can comprise a drive member 630*e* that can be selectively engaged to one of the sets of ratchet teeth 72*e* to permit the ratcheting mechanism 602 to be used to rotate the handle 50*e*, and the yokes 600 about a longitudinal axis of the handle 50*e*. It will be appreciated that it would be necessary to arrange the longitudinal axis of the handle 50*e* so that it is coincident or approximately coincident with the axis of a desired one of the tool members 214*e* to facilitate the use of the ratcheting mechanism 602.

Figure 17:
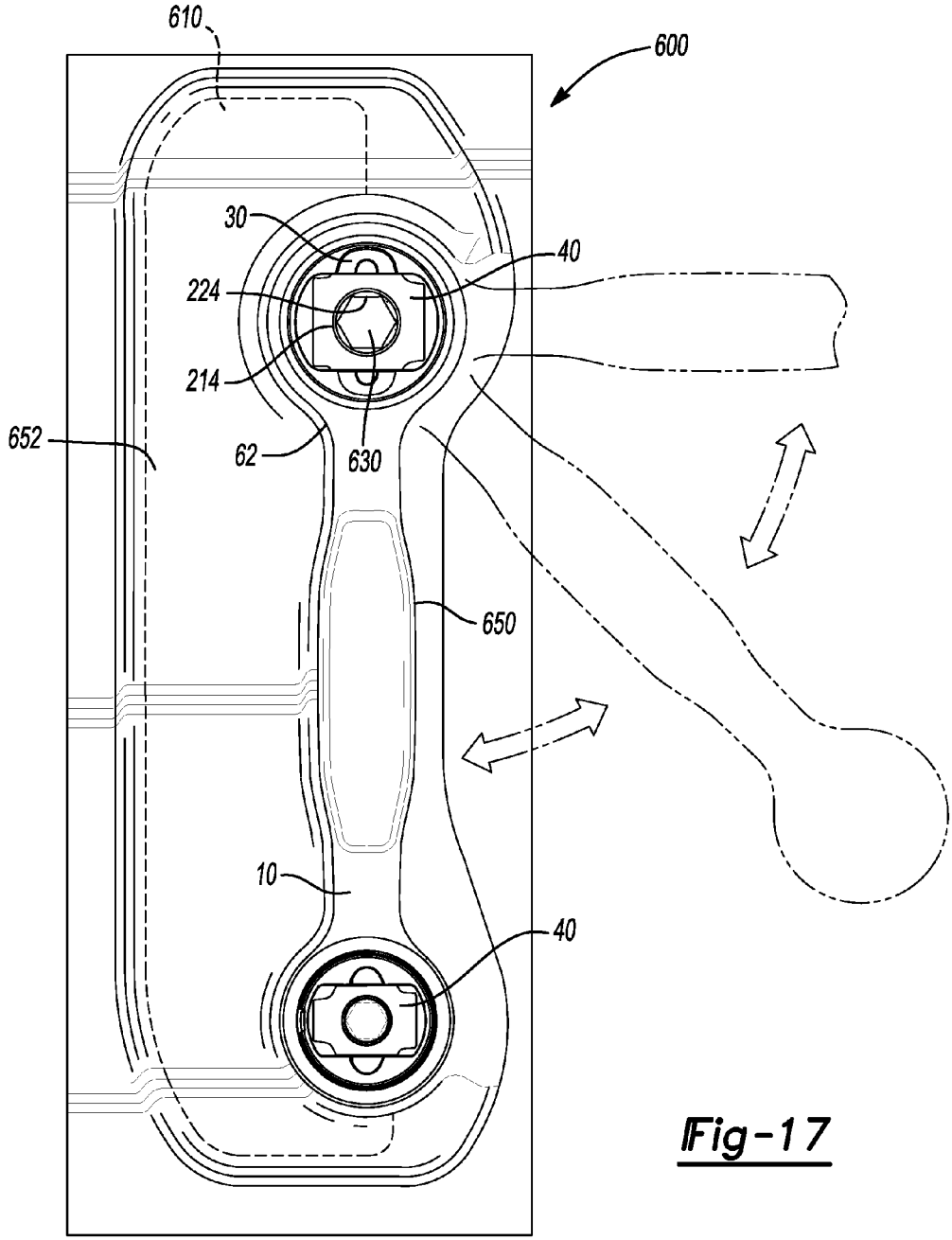
FIG. 17 is a top plan view of the ratcheting wrench of FIG. 1 in operative association with a packaging system constructed in accordance with the teachings of the present disclosure.

With reference to FIG. 17, a packaging system constructed in accordance with the teachings of the present disclosure is generally indicated by reference numeral 600. The packaging system 600 can be employed to package an exposed article, such as the ratcheting wrench 10, with other articles and/or materials in a manner that permits the exposed article to be secured with but be moved/pivoted relative to other packaged articles and/or materials. Non-limiting examples of other packaged articles include: duplicates of the exposed article; articles similar to but sized, shaped or colored differently from the exposed article; and articles employed for servicing or operation with the exposed article. Non-limiting examples of other packaged materials include: advertising materials; user's manuals; service manuals; warranty information; and promotional articles that are not intended for sale. In the particular example provided, the packaged articles and/or materials comprise printed matter 610 that can comprise an advertising insert and warranty information insert. The advertising insert can be formed of card stock and printed with inks of several colors, while the warranty information insert can be formed of paper printed in black ink and folded.

Figure 18:
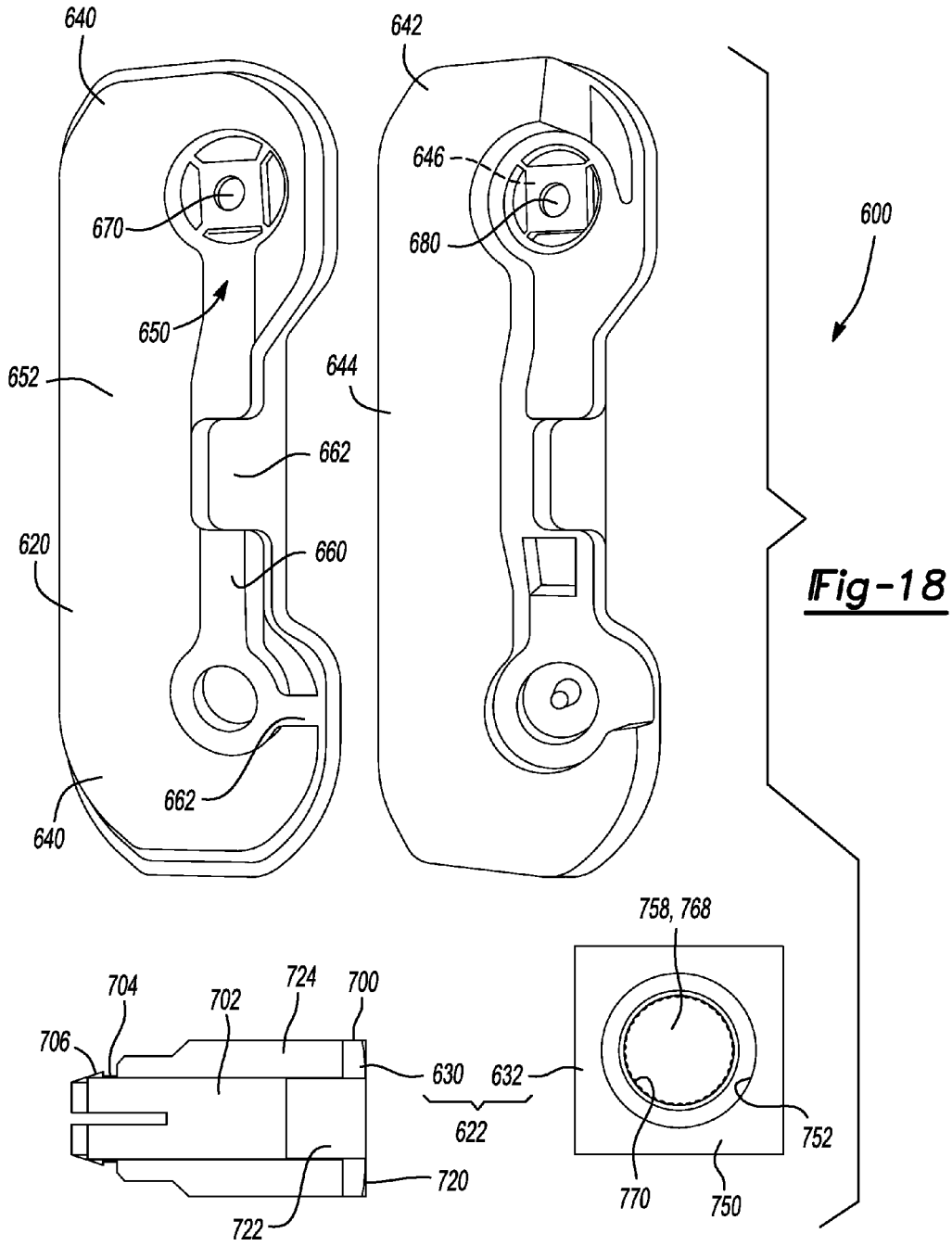
FIG. 18 is an exploded perspective view of the packaging system of FIG. 17.

With additional reference to FIG. 18, the packaging system 600 can include a package 620 and a connector assembly 622. The connector assembly 622 can include a front connector 630 and a rear connector 632.

The package 620 can include a front package portion 640 and a rear package portion 642 that can cooperate to form a first cavity 644 and a second cavity 646. In the particular example provided, the first cavity 644 is disposed on the interior of the package 620, while the second cavity 646 is a recess that is disposed in the rear exterior surface of the package 620, but it will be appreciated that the second cavity 646 could be disposed in the interior of the package 620. The package 620 can be formed in any manner desired, but in the particular example provided is thermoformed from a clear plastic and the front and rear package portions 640 and 642 are bonded or welded together.

The front package portion 640 can be somewhat larger than the ratcheting wrench 10 and can define a nest portion 650 and a first display portion 652. The nest portion 650 can be configured to receive the ratcheting wrench 10 and in the particular example provided, includes a primary recess 660 that is matingly sized and shaped to the rear side of the ratcheting wrench 10. One or more clearance recesses 662 may be defined to permit relatively deep components, such as the socket wheel 40, to be moved across the front face of the front package portion 640 as the ratcheting wrench 10 is pivoted and/or to provide a consumer with an access point at which the handle 50 of the ratcheting wrench 10 may be grasped. A first fastening aperture 670 can be formed through the nest portion 650 generally in-line with the bore 224 in a tool member 214 of the socket wheel 40 when the ratcheting wrench 10 is received in the nest portion 650. The first display portion 652 can be generally flat and planar and can be disposed generally in-line with first cavity 644.

Figure 19:
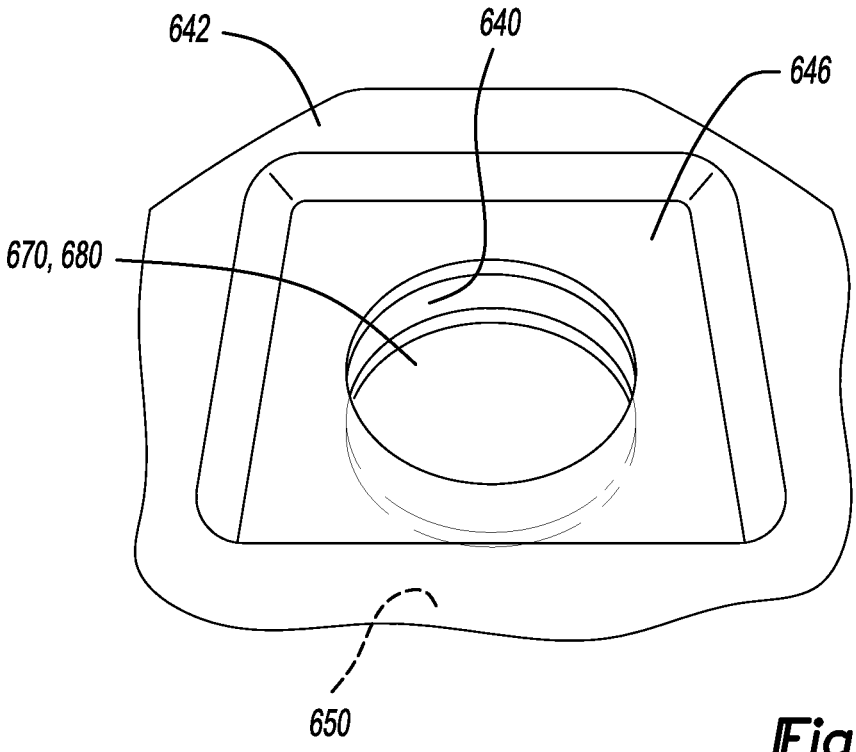
FIG. 19 is a rear perspective view of a portion of the packaging system of FIG. 17, illustrating the package in more detail.
Figure 20:
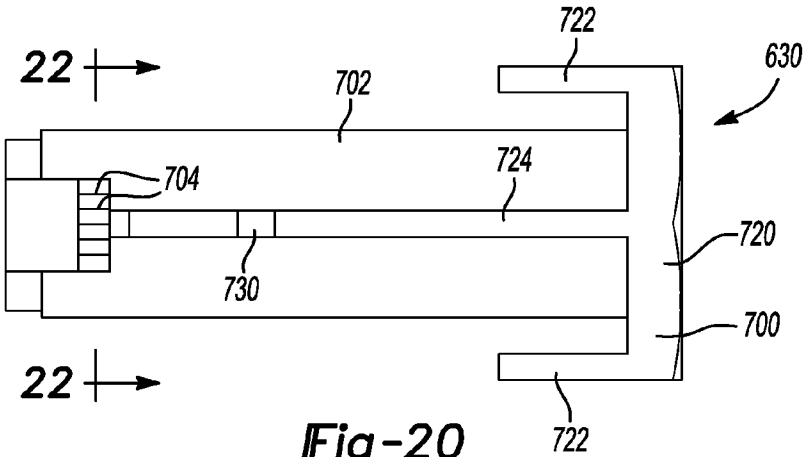
FIGS. 20 and 21 are side elevation views taken ninety degrees apart of a portion of the packaging system of FIG. 17, illustrating a front connector in more detail.
Figure 22:
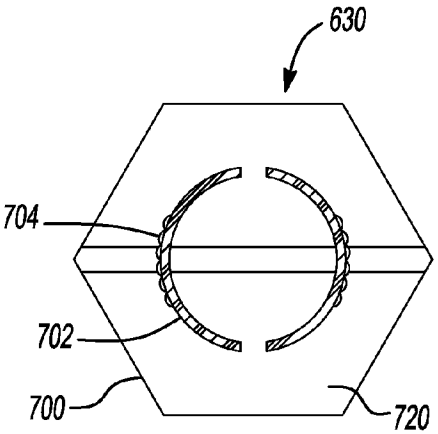
FIG. 22 is a section view taken along the line 22-22 of FIG. 20.

With additional reference to FIG. 19, the rear package portion 642 can be complementary to the front package portion 640 to a desired degree and can close and optionally help to further define the first cavity 644. The second cavity 646 on the rear exterior surface of the rear package portion 642 can have any desired non-circular shape, but in the example provided is generally square-shaped. A second fastening aperture 680, which can intersect (e.g., be positioned within) the second cavity 646, can be formed through the rear package portion 642 coaxially (inline) with the first fastening aperture 670.

The packaged articles and/or materials (e.g., the printed matter 610 in the example provided) can be received in the first cavity 644 and can be visible through desired portions of the package 620, such as the first display portion 652, in situations where the package 620 is formed of a transparent material. The exposed article (e.g., the ratcheting wrench 10 in the example provided) can be received in the nest portion 650 and the connector assembly 622 can be disposed through the exposed article and the first and second fastening apertures 670 and 680 to pivotally couple the exposed article to the package 620 as will be described in more detail below.

With reference to FIGS. 18 and 20 through 22, the front connector 630 can be formed of a suitable material, such as ABS plastic, and can define a head 700, a stem 702, a plurality of ratcheting ribs 704 and a plurality of barbs 706. The head 700 can be configured to be non-rotatably engage an associated one of the tool members 214 (FIG. 17) on the socket wheel 40 (FIG. 17). For example, the head 700 can be configured to be received in the bore 224 (FIG. 17) in an associated one of the tool members 214 (FIG. 17) such that it bottoms-out against an internal surface (not shown) within the socket wheel 40 (FIG. 17), such as the back-side of a tool member 214 (FIG. 17) disposed opposite the tool member 214 (FIG. 17) into which the front connector 630 is inserted. In the particular example provided, the head 700 comprises a hexagonal-shaped upper head member 720, a pair of end tabs 722 and a pair of central ribs 724. The upper head member 720 can be coupled to a first end of the stem 702. The end tabs 722 can be coupled to opposite sides of the upper head member 720 and can extend rearwardly therefrom generally parallel to the stem 702. The end tabs 722 can be shaped to engage opposite sides of the bore 224 (FIG. 17) in the tool member 214 (FIG. 17) to help center the front connector 630 within the tool member 214 (FIG. 17). Each of the central ribs 724 can be disposed between the end tabs 722 on an opposite side of the stem 702 and can extend rearwardly from the top head 700. The central ribs 724 can be contoured in a desired manner to contact the internal surface (not shown) of the socket wheel 40 (FIG. 17). In the example provided, the central ribs 724 comprise a first abutment surface 730, which is configured to abut the internal surface in the socket wheel 40 (FIG. 17), and a second abutment surface 732. A slot 736 can be formed in the stem 702 on a side opposite the top head 700 to facilitate radial deflection of the front connector 630 for assembly to or disassembly from the rear connector 632. Each of the barbs 706 can be fixedly coupled to the stem 702 and can diverge away from the stem 702 with increasing distance toward the top head 700 so as to form a shoulder 740. The ratcheting ribs 704 can be formed about the exterior of the stem 702 between the shoulder 740 and the second abutment surface 732.

Figure 23:
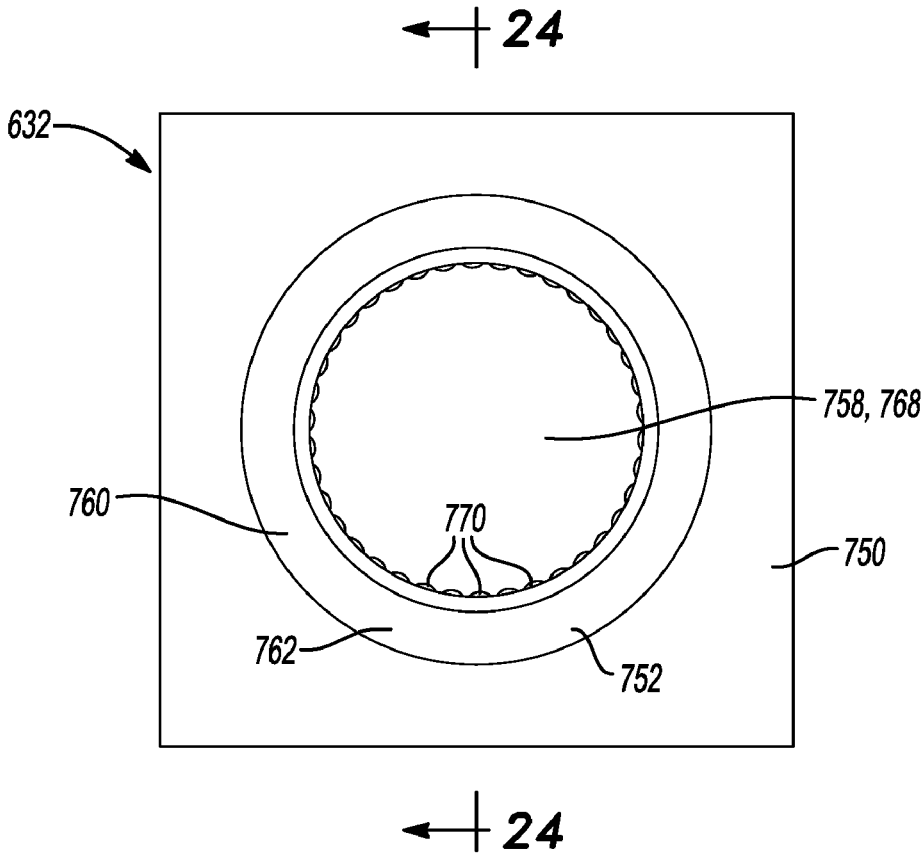
FIG. 23 is a top plan view of a portion of the packaging system of FIG. 17, illustrating a rear connector in more detail.
Figure 24:
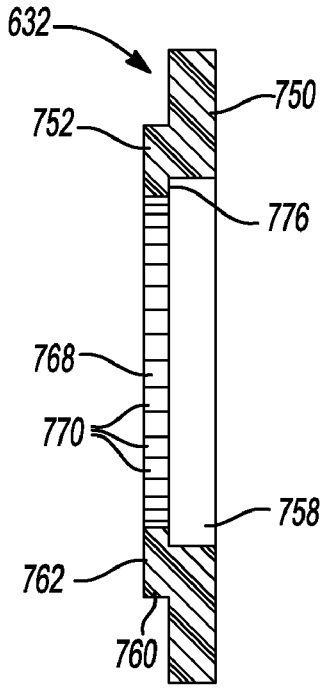
FIG. 24 is a section view taken along the line 24-24 of FIG. 23.
Figure 25:
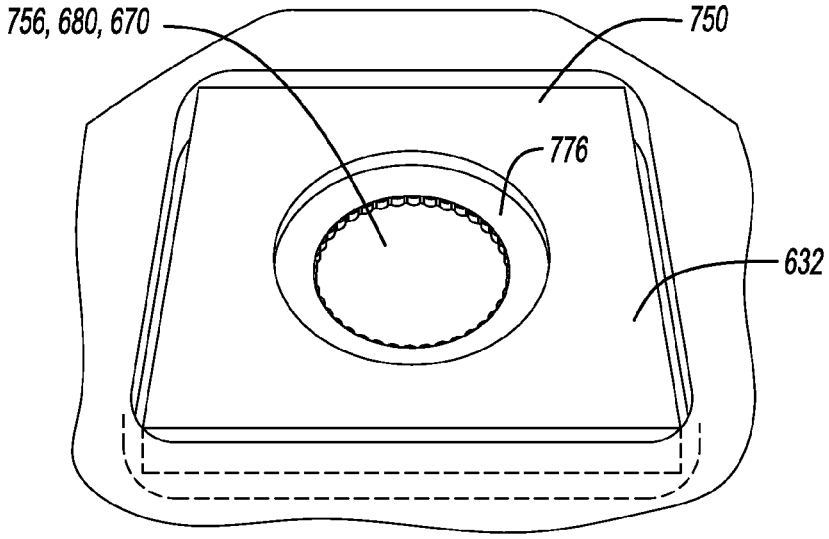
FIG. 25 is a view similar to that of FIG. 19 but illustrating the rear connector in place against the package.

With reference to FIGS. 18, 23 and 24, the rear connector 632 can comprise a first body portion 750 and a second body portion 752. The first body portion 750 can be sized to be non-rotatably received in the second cavity 646. A clearance hole 758 can be formed through the first body portion 750 and can be disposed coaxially (i.e., in-line) with the first and second fastener apertures 670 and 680 (FIG. 25). The second body portion 752 can be fixedly coupled to a side of the first body portion 750 that faces the package 620 and can comprise an annular body 760 that defines an abutment surface 762 that is configured to abut the rear surface of the rear package portion 642. The second body portion 752 can define a coupling aperture 768 having a plurality of ridges or teeth 770 that are formed about the circumference of thereof. The coupling aperture 768 can be disposed coaxially with the clearance hole 758. In the particular example provided, the clearance hole 758 is somewhat larger in diameter than the coupling aperture 768 and as such, an annular shoulder 776 is formed where the first and second body portions 750 and 752 abut one another.

Figure 21:
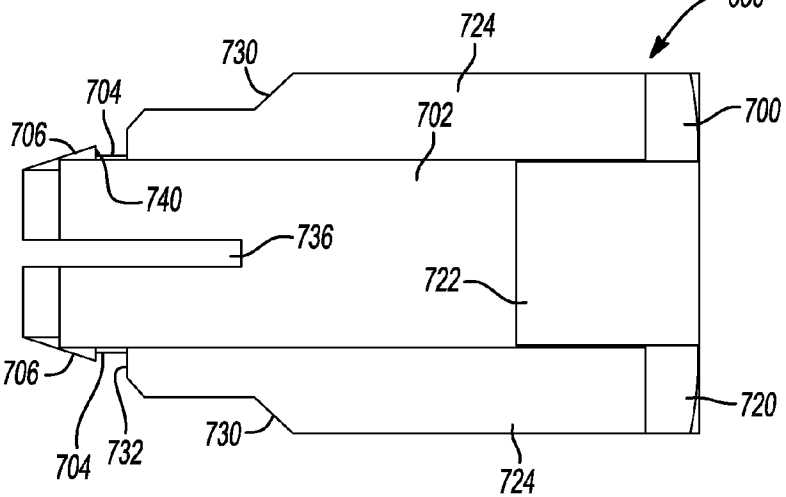

With reference to FIGS. 21 and 24, the coupling aperture 768 and clearance hole 758 can be sized to receive the stem 702 therethrough. More specifically, insertion of the stem 702 into the coupling aperture 768 can squeeze the slotted end of the stem 702 together to permit the barbs 706 to pass axially through the second body portion 752 so that the such that the shoulders 740 of the barbs 706 can be abutted against the annular shoulder 776, the second abutment surface 732 can be abutted against the abutment surface 762, and the ratcheting ribs 704 can be engaged with the teeth 770 of the coupling aperture 768.

With renewed reference to FIGS. 17 and 18, the fit between the teeth 770 and the ratcheting ribs 704 can be configured to resist relative rotation between the front and rear connectors 630 and 632 when the ratcheting wrench 10 is rotated relative to the packaging system 600 in a direction that causes the ratchet clutch of the ratcheting wrench 10 to rotationally decouple the ratchet body 30 from the ratchet structure 62, but to permit relative rotation between the front and rear connectors 630 and 632 when the ratcheting wrench 10 is rotated relative to the packaging system 600 in a direction that causes the ratchet clutch of the ratcheting wrench 10 to rotationally couple the ratchet body 30 to the ratchet structure 62. Configuration in this manner permits a consumer to handle the ratcheting wrench 10, as well as test the ratcheting mechanism of the ratcheting wrench 10 without decoupling the ratcheting wrench 10 from the package 620.

It will be appreciated that a rear connector 632 constructed in accordance with the teachings of the present disclosure could be formed in a planar manner having only a single body structure and that the clearance aperture 758 can be formed through the single body structure such that the annular shoulder 776 (FIG. 24) is defined by a rear planar surface of the rear connector 632. It will be appreciated, however, that in contrast to the particular example illustrated and disclosed herein, the shoulders 740 (FIG. 21) of the barbs 706 (and the radially outwardly ends or points of the barbs 706) would not be received within the clearance hole 758 and would not be shrouded around the periphery of the front connector 630.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A ratcheting wrench comprising:

a ratchet structure having a body;

a ratchet body received in the body of the ratchet structure and being rotatable relative thereto about a first axis;

a socket wheel pivotally coupled to the ratchet body for rotation about a second axis, the second axis being perpendicular to the first axis, the socket wheel comprising a plurality of tool members that are spaced circumferentially apart from one another about the second axis;

a one-way clutch coupling the ratchet body and the body of the ratchet structure;

wherein the one-way clutch comprises a plurality of ratchet teeth and at least one pawl that is engageable to the ratchet teeth;

wherein the at least one pawl comprises a single pawl member having a first set of pawl teeth and a second set of pawl teeth; and wherein the single pawl member is movable into a position where both the first and second sets of pawl teeth are engaged to the ratchet teeth.

2. The ratcheting wrench of claim 1, wherein the ratchet teeth are non-rotatably coupled to the ratchet structure.

3. The ratcheting wrench of claim 1, wherein the one-way clutch further comprises at least one torsion spring for biasing the single pawl member into engagement with the ratchet teeth.

4. The ratcheting wrench of claim 3, wherein a first end of the torsion spring is mounted to the single pawl member, wherein a second end of the torsion spring is mounted to a selector ring that is rotatably disposed on the ratchet structure and wherein the selector ring is rotatable relative to the ratchet body to control a mode in which the one-way clutch operates.

5. The ratcheting wrench of claim 1, wherein the socket wheel is permanently coupled to the ratchet body.

6. The ratcheting wrench of claim 1, wherein a bore is formed at least partly through at least one of the plurality of tool members, the bore having a non-circular shape.

7. The ratcheting wrench of claim 6, wherein the non-circular shape is hexagonal.

8. The ratcheting wrench of claim 1, wherein the one-way clutch further comprises at least one spring for biasing the single pawl member into engagement with the ratchet teeth.

9. The ratcheting wrench of claim 1, wherein said position of said pawl member inhibits rotation of the ratchet body relative to the body of the ratchet about said first axis in both a first rotational direction and a second rotational direction that is opposite said first rotational direction.

10. The ratcheting wrench of claim 1, wherein the socket wheel comprises four tool members.

11. The ratcheting wrench of claim 10, wherein the four tool members each define a female aperture.

12. The ratcheting wrench of claim 10, wherein each of the four tool members comprise female apertures with splines.

13. The ratcheting wrench of claim 10, wherein each of the four tool members include hexagonally shaped bores.

14. The ratcheting wrench of claim 1, wherein the first set of pawl teeth is spaced apart from the second set of pawl teeth on the single pawl member.

15. The ratcheting wrench of claim 14, further comprising an angular segment between the first set of pawl teeth and a second set of pawl teeth.

16. The ratcheting wrench of claim 1, wherein the socket wheel is coupled to the ratchet body by at least one pivot pin.

17. The ratcheting wrench of claim 16, wherein the socket wheel is coupled to the ratchet body by a pair of pivot pins.

* * * * *